US010451989B2

(12) United States Patent
Kojima et al.

(10) Patent No.: US 10,451,989 B2
(45) Date of Patent: Oct. 22, 2019

(54) TONER, TONER STORED UNIT, AND IMAGE FORMING APPARATUS

(71) Applicants: Satoshi Kojima, Kanagawa (JP); Satoshi Takahashi, Kanagawa (JP); Tatsuru Moritani, Shizuoka (JP); Shosuke Aoai, Kanagawa (JP); Tatsuki Yamaguchi, Shizuoka (JP)

(72) Inventors: Satoshi Kojima, Kanagawa (JP); Satoshi Takahashi, Kanagawa (JP); Tatsuru Moritani, Shizuoka (JP); Shosuke Aoai, Kanagawa (JP); Tatsuki Yamaguchi, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/119,653

(22) Filed: Aug. 31, 2018

(65) Prior Publication Data

US 2018/0373174 A1 Dec. 27, 2018

Related U.S. Application Data

(63) Continuation of application No. PCT/JP2017/004659, filed on Feb. 9, 2017.

(30) Foreign Application Priority Data

Mar. 3, 2016 (JP) ..... 2016-040836

(51) Int. Cl.
*G03G 9/08* (2006.01)
*G03G 9/097* (2006.01)
(Continued)

(52) U.S. Cl.
CPC ..... *G03G 9/09725* (2013.01); *G03G 9/08* (2013.01); *G03G 9/0819* (2013.01);
(Continued)

(58) Field of Classification Search
CPC ..... G03G 9/09708; G03G 9/09716; G03G 9/09725; G03G 9/0825; G03G 9/0827; G03G 9/0821
(Continued)

(56) References Cited

U.S. PATENT DOCUMENTS 8,778,588 B2 7/2014 Kusahara et al.
8,835,086 B2 9/2014 Watanabe et al.
(Continued)

FOREIGN PATENT DOCUMENTS

EP 2 896 996 A1 7/2015
JP 3796107 4/2006
(Continued)

OTHER PUBLICATIONS

International Search Report dated May 9, 2017 for counterpart International Patent Application No. PCT/JP2017/004659 filed Feb. 9, 2017 (with English Translation).
(Continued)

*Primary Examiner* — Mark A Chapman
(74) *Attorney, Agent, or Firm* — Oblon, McClelland, Maier & Neustadt, L.L.P.

(57) ABSTRACT

Provided is a toner including toner base particles and an external additive, wherein each of the toner base particles includes a binder resin, a release agent, and silica, an average abundance ratio ($X_{surf}$) of the silica on a region adjacent to a surface of the toner base particle is from 70% through 90%, and a projected area average value S(180) per particle of the toner when the toner is heated to 180° C. and a projected area average value S(30) per particle of the toner when the toner is 30° C. satisfy Formula (1) below, $$1.4 \leq S(180)/S(30) \leq 1.7 \quad \text{Formula (1).}$$

9 Claims, 6 Drawing Sheets

(51) Int. Cl.
*G03G 9/087* (2006.01)
*G03G 15/08* (2006.01)

(52) U.S. Cl.
CPC ..... *G03G 9/0821* (2013.01); *G03G 9/0825* (2013.01); *G03G 9/0827* (2013.01); *G03G 9/08755* (2013.01); *G03G 9/09708* (2013.01); *G03G 9/09716* (2013.01); *G03G 15/0865* (2013.01)

(58) Field of Classification Search
USPC ..... 430/108.7
See application file for complete search history.

(56) References Cited

U.S. PATENT DOCUMENTS

| | | | |
|---|---|---|---|
| 9,069,288 | B2 | 6/2015 | Kojima et al. |
| 2006/0216628 | A1 | 9/2006 | Nakamura et al. |
| 2006/0286476 | A1 | 12/2006 | Vanbesien et al. |
| 2007/0059063 | A1 | 3/2007 | Nakayama et al. |
| 2007/0218383 | A1 | 9/2007 | Seshita et al. |
| 2007/0218385 | A1 | 9/2007 | Kojima et al. |
| 2008/0069616 | A1 | 3/2008 | Kojima et al. |
| 2008/0070144 | A1 | 3/2008 | Nagatomo et al. |
| 2008/0227015 | A1 | 9/2008 | Nagatomo et al. |
| 2008/0233505 | A1 | 9/2008 | Nagatomo et al. |
| 2009/0067876 | A1 | 3/2009 | Seshita et al. |
| 2009/0142093 | A1 | 6/2009 | Sawada et al. |
| 2009/0142094 | A1 | 6/2009 | Sawada et al. |
| 2009/0142685 | A1 | 6/2009 | Nagatomo et al. |
| 2009/0142686 | A1 | 6/2009 | Kojima et al. |
| 2010/0075243 | A1 | 3/2010 | Shimota et al. |
| 2010/0119255 | A1 | 5/2010 | Seshita et al. |
| 2011/0003244 | A1 | 1/2011 | Inoue et al. |
| 2011/0033794 | A1 | 2/2011 | Watanabe et al. |
| 2011/0065033 | A1 | 3/2011 | Uchinokura et al. |
| 2011/0255899 | A1 | 10/2011 | Iwamoto et al. |
| 2011/0262856 | A1 | 10/2011 | Sugimoto et al. |
| 2011/0305986 | A1 | 12/2011 | Ogawa et al. |
| 2012/0064445 | A1 | 3/2012 | Kojima et al. |
| 2012/0264049 | A1 | 10/2012 | Masuda et al. |
| 2012/0270147 | A1 | 10/2012 | Katoh et al. |
| 2013/0069263 | A1 | 3/2013 | Katoh et al. |
| 2013/0157193 | A1 | 6/2013 | Moritani et al. |
| 2013/0224648 | A1 | 8/2013 | Honda et al. |
| 2013/0243488 | A1 | 9/2013 | Kojima et al. |
| 2013/0244155 | A1 | 9/2013 | Satoh et al. |
| 2013/0244156 | A1 | 9/2013 | Kojima et al. |
| 2013/0244158 | A1 | 9/2013 | Awamura et al. |
| 2013/0273188 | A1 | 10/2013 | Takahashi et al. |
| 2014/0038100 | A1 | 2/2014 | Katoh et al. |
| 2014/0072349 | A1 | 3/2014 | Sakashita et al. |
| 2014/0097267 | A1 | 4/2014 | Shitara et al. |
| 2014/0140731 | A1 | 5/2014 | Hozumi et al. |
| 2014/0141110 | A1 | 5/2014 | Katoh et al. |
| 2014/0220485 | A1 | 8/2014 | Kojima et al. |
| 2014/0234767 | A1 | 8/2014 | Awamura et al. |
| 2014/0242514 | A1 | 8/2014 | Inoue et al. |
| 2014/0270874 | A1 | 9/2014 | Hase et al. |
| 2014/0272695 | A1 | 9/2014 | Moritani et al. |
| 2015/0104739 | A1 | 4/2015 | Nagatomo et al. |
| 2015/0108671 | A1 | 4/2015 | Norikane et al. |
| 2015/0198902 | A1 | 7/2015 | Saito et al. |
| 2015/0234303 | A1 | 8/2015 | Moriya et al. |
| 2015/0241804 | A1 | 8/2015 | Takahashi et al. |
| 2015/0253685 | A1 | 9/2015 | Suzuki et al. |
| 2015/0261111 | A1 | 9/2015 | Inoue et al. |
| 2015/0261144 | A1 | 9/2015 | Sakashita et al. |
| 2015/0362852 | A1 | 12/2015 | Moriya et al. |
| 2016/0004178 | A1 | 1/2016 | Sugiura et al. |
| 2016/0077455 | A1 | 3/2016 | Moriya et al. |
| 2016/0124332 | A1 | 5/2016 | Takahashi et al. |
| 2016/0147167 | A1 | 5/2016 | Moritani et al. |
| 2016/0266521 | A1 | 9/2016 | Inoue et al. |
| 2016/0274527 | A1 | 9/2016 | Gohda et al. |
| 2017/0153574 | A1 | 6/2017 | Kojima et al. |

FOREIGN PATENT DOCUMENTS

| | | |
|---|---|---|
| JP | 2006-267231 | 10/2006 |
| JP | 2007-108684 | 4/2007 |
| JP | 2008-065005 | 3/2008 |
| JP | 2008-089919 | 4/2008 |
| JP | 4907475 | 1/2012 |
| JP | 2012-118362 | 6/2012 |
| JP | 2014-199420 A | 10/2014 |
| JP | 2015-026060 | 2/2015 |
| JP | 2015-169892 | 9/2015 |
| JP | 2015-179252 A | 10/2015 |

OTHER PUBLICATIONS

Written Opinion dated May 9, 2017 for counterpart International Patent Application No. PCT/JP2017/004659 filed Feb. 9, 2017.
Extended European Search Report dated Jan. 15, 2019 in the corresponding European Application No. 17759593.1 5 pages.
Information Offer Form dated Apr. 2, 2019 in Japanese Patent Application No. 2018-502988 (with English translation), 22 pages.

TONER, TONER STORED UNIT, AND IMAGE FORMING APPARATUS

CROSS-REFERENCE TO RELATED APPLICATIONS

The present application is a continuation application of International Application No. PCT/JP2017/004659, filed Feb. 9, 2017, which claims priority to Japanese Patent Application No. 2016-040836, filed Mar. 3, 2016. The contents of these applications are incorporated herein by reference in their entirety.

BACKGROUND OF THE INVENTION

Field of the Invention

The present disclosure relates to a toner, a toner stored unit, and an image forming apparatus.

Description of the Related Art

Lately, demands of the market for image quality have increased further and there is a need for a toner that can provide an image having a wide range of glossiness from low glossiness to high glossiness depending on the intended use. There is a problem that viscoelasticity of a toner is to be appropriately controlled and a fixing temperature width is to be widened in order to obtain a toner having a wide glossiness range.

As a technique for solving the above-mentioned problem, addition of a salicylic acid metal salt as a component into a toner has been known (see Japanese Unexamined Patent Application Publication No. 2015-169892). As a result of the addition of the salicylic acid metal salt, a cross-linking reaction between an acid group of a binder resin and the salicylic acid metal salt progresses to form a weak three-dimensional crosslink, and therefore a wide fixing temperature width can be obtained.

When the salicylic acid metal salt is used, however, there is a problem that aggregation of a pigment occurs depending on a formulation of a toner, leading to low image density of the toner.

As another technique, moreover, use of a crosslinked resin to control gloss of a toner has been known (see Japanese Patent Nos. 3796107 and 4907475). Use of a resin having a crosslink structure as a binder resin enables to control gloss according to a crosslinking degree of the resin.

When the crosslinked resin is used, however, there is a problem that a glossiness width of a toner is narrower than a toner using the salicylic acid metal salt.

SUMMARY OF THE INVENTION

According to one aspect of the present disclosure, a toner includes toner base particles and an external additive. Each of the toner base particles includes a binder resin, a release agent, and silica. An average abundance ratio ($X_{surf}$) of the silica on a region adjacent to a surface of the toner base particle is from 70% through 90%. A projected area average value S(180) per particle of the toner when the toner is heated to 180° C. and a projected area average value S(30) per particle of the toner when the toner is 30° C. satisfy Formula (1) below.

$$1.4 \leq S(180)/S(30) \leq 1.7 \quad \text{Formula (1)}$$

DESCRIPTION OF THE EMBODIMENTS (Toner)

Figure 1:
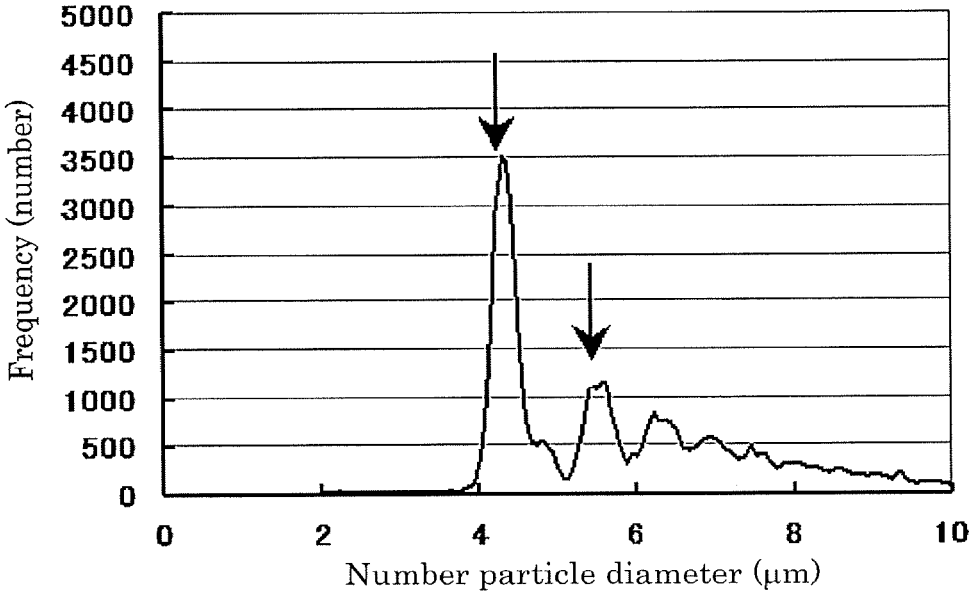
FIG. 1 is a graph depicting one example of a distribution plotting a number particle diameter and frequency (number) of a toner of the present disclosure.

A toner of the present disclosure includes at least toner base particles and an external additive.

Each of the toner base particles includes at least a binder resin, a release agent, and silica, and may further include other ingredients according to the necessity.

An average abundance ratio ($X_{surf}$) of the silica on a region adjacent to a surface of the toner base particle is from 70% through 90%.

A projected area average value S(180) per particle of the toner when the toner is heated to 180° C. and a projected area average value S(30) per particle of the toner when the toner is 30° C. satisfy Formula (1) below.

$$1.4 \leq S(180)/S(30) \leq 1.7 \quad \text{Formula (1)}$$

The present disclosure has an object to provide a toner that can obtain optimal glossiness without inhibiting low-temperature fixability and can suppress gloss unevenness.

The present disclosure can provide a toner that can obtain optimal glossiness without inhibiting low-temperature fixability and can suppress gloss unevenness.

The toner of the present disclosure has appropriate spreadability of the toner and bleedability of the release agent when the toner is heated. Therefore, optimal glossiness can be obtained without inhibiting low-temperature fixability of the toner and gloss unevenness can be suppressed.

<$X_{surf}$>

In the present disclosure, an average abundance ratio ($X_{surf}$) of the silica on a region adjacent to a surface of the toner base particle is from 70% through 90%. In this case, the average abundance ratio ($X_{surf}$) of the silica adjacent to a surface of the toner base particle represents an average abundance ratio of the silica in a region that is within 200 nm from a surface of the toner base particle in a cross-sectional image obtained by a transmission electron microscope (TEM).

The toner having $X_{surf}$ of from 70% through 90% has irregular shape because appropriate convex-concave shapes are formed on surfaces of particles of the toner, can obtain optimal glossiness, and can suppress gloss unevenness. The average abundance ratio $X_{surf}$ of the silica in the region within 200 nm from a surface of the toner particle is from 70% through 90%, and preferably from 75% through 85%.

When the abundance ratio $X_{surf}$ is less than 70%, a difference in density between the area adjacent a surface of the toner base particle and the entire toner base particle is not sufficient and the toner spreads excessively, and gloss becomes too high and there is also a concern regarding occurrence of gloss unevenness. When the abundance ratio $X_{surf}$ is greater than 90%, on the other hand, an amount of the silica exposed to a surface of the toner is large to inhibit bleeding of the release agent, and therefore fixability is deteriorated. Note that, a silica layer is preferably formed along a surface profile (convex-concave state) of a toner base particle, but a whole area adjacent to a surface of a toner base particle does not need to be a silica layer.

For example, the average abundance ratio $X_{surf}$ of the silica can be determined as follows.

Toner base particles are dispersed in a 67% by mass sucrose saturated aqueous solution and the resultant is frozen at −100° C. Then, the frozen solution is sliced into a slice having a thickness of about 1,000 Angstrom by Cryomicrotome (EM-FCS, available from Laica). A photograph of a cross-section of particles is taken by a transmission electron microscope (JEM-2010, available from JEOL Ltd.) with magnification of 10,000 times, and an area ratio of a silica shadow in a region that is a part from a surface of a toner base particle to 200 nm in thickness towards inside the particle in a vertical direction on a cross-section with which the cross-sectional area is the maximum is determined by an image analyzer (nexus NEW CUBE ver. 2.5, available from NEXUS). For the measurement, randomly selected 10 toner particles are measured and an average value of the measured values is determined as a measurement value.

<Thickness of Silica Layer>

A thickness of a silica layer formed adjacent to a surface of the toner base particle can be measured by performing image analysis of an image of a cross-section of a toner base particle taken by a transmission electron microscope (TEM).

Specifically, a toner is dispersed in a 67% by mass sucrose saturated solution and a resultant is frozen at −100° C. The frozen solution is sliced into a slice having a thickness of about 1,000 Angstrom (Å) by Cryomicrotome and the silica is dyed with ruthenium tetroxide. Thereafter, a photograph of a cross-section of the resin particle taken by a transmission electron microscope at the magnification of 10,000 times. For example, by means of an image analyzer (nexus NEW CUBE ver. 2.5, available from NEXUS), the maximum distance with which an area of a silica layer occupies 50% or greater of an area of a region set by taking a thickness by a certain distance vertically inwards from a surface of a toner base particle on a cross-section of the toner base particle, on which the cross-sectional area is maximum, is determined as a thickness of the silica layer.

Note that, the measurement value above is an average value calculated from the values measured on randomly selected 10 resin particles.

Note that, in the case where it is difficult to distinguish between the silica layer and the resin upon observation of an TEM image, mapping is performed on a resin particle cross-section obtained by the above-described method by any of various devices (e.g., energy dispersive X-ray spectrometer (EDX) and electron energy loss spectrometer (EELS)) capable of performing composition mapping, a silica layer is identified from the composition distribution image obtained by the analysis, and then a thickness of the silica layer can be calculated according to the above-described method.

Typically, a thickness of the silica layer is preferably from 0.005 μm through 0.5 μm, more preferably from 0.01 μm through 0.2 μm, and even more preferably from 0.02 μm through 0.1 μm. In order to form such a silica layer, a toner material liquid prepared by dispersing and/or dissolving at least a binder resin and silica in an organic solvent is ejected to form droplets and just after the formation of the droplets, the droplets are rapidly dried to form solid particles, and a solvent (may be referred to as "solvent etc." hereinafter) is dried to produce toner base particles to form a silica layer.

It is assumed that the convex-concave shapes of a surface of the toner base particle is formed because speed for reducing a surface area becomes significantly slow due to a silica layer formed at the time of volume reduction of a toner particle in a step of drying the solvent etc., to thereby make the surface of the toner particle appropriately elastic, and as a result, the viscosity of the particle surface becomes higher than the viscosity of the inner area of the particle.

<S(180)/S(30)>

In the present disclosure, S(180)/S(30) is from 1.4 through 1.7 where S(180)/S(30) is a ratio of a projected area average value S(180) per particle of the toner when the toner is heated to 180° C. to a projected area average value S(30) per particle of the toner when the toner is 30° C. S(180)/S(30) is preferably from 1.5 through 1.6.

S(180)/S(30) represents spreadability of toner particles when the toner is heated. The smaller the value of S(180)/S(30) is, less likely spread of the toner particles occurs due to heat, i.e., more difficult to melt and spread the toner particles. The larger the value thereof is, spread of the toner particles due to heat becomes significant, i.e., easier to melt and spread the toner particles. When the spreadability is low, it is easily maintain boundaries of particles at the time of fixing and a resultant image tends to be matte and has low gloss. When the spreadability is high, on the other hand, the boundaries of particles tend are easily lost by fixing and a resultant image tends to have high gloss.

When S(180)/S(30) is lower than 1.4, the toner hardly spreads and gives excessively low gloss, and a resultant color tone becomes dull in a color image, and therefore such a toner is not suitable for printing of photographs. When S(180)/S(30) is greater than 1.7, spreadability of the toner becomes too high and glare of an image becomes noticeable, and therefore such a toner is not suitable for printing of documents. When S(180)/S(30) is in the range of from 1.4 through 1.7, appropriate gloss is provided to an image and moreover gloss unevenness hardly occurs.

<<Measuring Method of Particle Projected Area at the Time of Heating>>

A toner is placed on gloss paper POD gloss-coated paper 128 (available from Oji Paper Co., Ltd.) in a manner that particles are each present as a single particle as much as possible using air flow.

Next, the gloss paper, on which the toner has been placed, is cut out into a piece having sides of 1 cm, and then the cut piece is set in a heating device for a microscope (available from JAPAN HIGH TECH CO., LTD.) and is heated at a temperature from 30° C. through 180° C. at 10° C./min.

The state of the cut piece during heating is observed under a microscope and the state of the toner being melted and spread is taken into a PC as a video. In this case, the observation magnification is the magnification at which a region of 400 μm×400 μm can be observed. The image of the particles of the toner at 30° C. and the image of the particles of the toner at 180° C. are analyzed by image processing software to calculate an area of each of 100 particles. Then, S(180)/S(30), which is a ratio of an area of a particle at 180° C. (S(180)) to an area of a particle at 30° C. (S(30)), is determined.

<Toner Base Particles>

Each of the toner base particles includes at least a binder resin, a release agent, and silica, and may further include other ingredients according to the necessity.

<<Binder Resin>>

The binder resin is not particularly limited as long as the binder resin is a binder resin that is dissolved in an organic solvent used in a production method described below, and may be appropriately selected from resins known in the art depending on the intended purpose. Examples of the binder resin include: homopolymers of vinyl monomers, such as styrene monomers, acryl monomers, and methacryl monomers; copolymers composed of two or more of the above-listed monomers; polyester resins; polyol resins; phenol resins; silicone resins; polyurethane resins; polyamide resins; furan resins; epoxy resins; xylene resins; terpene resins; coumarone-indene resins; polycarbonate resins; and petroleum-based resins. The above-listed examples may be used alone or in combination.

—Polyester Resin—

Monomers that constitute the polyester resin (polyester-based polymer) are not particularly limited and may be appropriately selected depending on the intended purpose. The polyester resin preferably includes an alcohol component and an acid component.

Examples of the alcohol components are as follows.

Examples of a divalent alcohol component include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and diols obtained through polymerization between bisphenol A and cyclic ether, such as ethylene oxide and propylene oxide.

The polyester resin can be crosslinked by using trivalent or higher multivalent alcohol and trivalent or higher acid in combination, but amounts of such multivalent alcohol and trivalent or higher acid for use are adjusted to amounts with which the resin is not prevented from being dissolved with an organic solvent.

Examples of the trivalent or higher multivalent alcohol include sorbitol, 1,2,3,6-hexanetetrol, 1,4-sorbitan, pentaerythritol, dip entaerythritol, trip entaerythritol, 1,2,4-butanetriol, 1,2,5-pentatriol, glycerol, 2-methylpropanetriol, 2-methyl-1,2,4-butanetriol, trimethylolethane, trimethylolpropane, and 1,3,5-trihydroxybenzene.

Examples of the acid component constituting the polyester resin include: benzene dicarboxylic acids, such as phthalic acid, isophthalic acid, and terephthalic acid, or anhydrides thereof; alkyl dicarboxylic acids, such as succinic acid, adipic acid, sebacic acid, and azelaic acid, or anhydrides thereof; unsaturated dibasic acids, such as maleic acid, citraconic acid, itaconic acid, alkenyl succinic acid, fumaric acid, and mesaconic acid; and unsaturated dibasic acid anhydrides, such as maleic acid anhydride, citraconic acid anhydride, itaconic acid anhydride, and alkenyl succinic acid anhydride.

Moreover, examples of the trivalent or higher multivalent carboxylic acid component include trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxy-2-methyl-2-methylenecarboxypropane, tetra(methylenecarboxy)methane, 1,2,7,8-octanetetracarboxylic acid, empol trimer acid, anhydrides thereof, and partial lower alkyl esters thereof.

In the present disclosure, an embodiment that the binder resin has a polyester resin as a main component is preferable. Particularly in the case where the below-described release agent is ester wax including fatty acid ester as a main component, an embodiment where a binder resin is a polyester resin and use of the polyester resin as the binder resin and the ester wax as the release agent in combination is more preferable.

In the case where the binder resin is a polyester resin, the polyester resin preferably has at least one peak present in a molecular weight region of from 3,000 through 50,000 in a molecular weight distribution of a THF soluble component of the resin component, in view of fixability and offset resistance of the toner. Moreover, the binder resin, in which the THF soluble component having a molecular weight of 100,000 or less is included in an amount of from 70% through 100%, is preferable in view of ejectability. Furthermore, the binder resin having at least one peak present in the molecular weight region of from 5,000 through 20,000 is more preferable.

In the present disclosure, a molecular weight distribution of the binder resin is measured by gel permeation chromatography (GPC) using THF as a solvent.

In a case where the binder resin is a polyester resin, an acid value of the polyester resin is not particularly limited and may be appropriately selected depending on the intended purpose. The acid value is preferably from 0.1 mgKOH/g through 100 mgKOH/g, more preferably from 0.1 mgKOH/g through 70 mgKOH/g, and even more preferably from 0.1 mgKOH/g through 50 mgKOH/g.

In the present disclosure, a basic operation of an acid value of a binder resin component of a toner composition is determined by the following method according to JIS K-0070.

(1) A sample is used by removing additives other than a binder resin (a polymer component) in advance. Alternatively, acid values and amounts of the binder resin and the components other than the cross-linked binder resin are determined in advance. A pulverized product of the sample is weighed by from 0.5 g through 2.0 g and a weight of the polymer component is determined as Wg. In the case where an acid value of the binder resin is measured from a toner, for example, an acid value and amount of a colorant or a magnetic body etc. are measured separately. An acid value of the binder resin is determined from calculation.

(2) A 300 mL beaker is charged with the sample, and 150 mL of a toluene/ethanol (volume ratio: 4/1) mixture liquid is added to dissolve the sample.

(3) Titration is performed by means of a potentiometric titrator using an ethanol solution of 0.1 mol/L of potassium hydroxide (KOH).

(4) At the time of titration, an amount of the KOH solution used is determined as S (mL). Simultaneously, a blank sample is measured and an amount of the KOH solution used for the blank sample is determined as B (mL). Then, an acid value is calculated by the following formula. Note that, f is a factor of KOH.

$$\text{Acid value(mgKOH/g)}=[(S-B)\times f\times 5.61]/W$$

A glass transition temperature (Tg) of the binder resin and a glass transition temperature (Tg) of a toner composition including the binder resin are not particularly limited and may be appropriately selected depending on the intended purpose. In view of storage stability of a toner, the glass transition temperatures (Tg) are preferably from 35° C. through 80° C. and more preferably from 40° C. through 70° C.

When the glass transition temperature (Tg) is lower than 35° C., a toner tends to be deteriorated in a high temperature environment. When the glass transition temperature (Tg) is higher than 80° C., fixiability may be impaired.

A binder resin can be appropriately selected from the above-listed examples depending on an organic solvent or a release agent for use. In the case where the release agent having excellent solubility to an organic solvent is used, a softening point of the toner may become low. In such a case, to increase a weight average molecular weight of the binder resin to increase a softening point of the binder resin is an effective method for favorably maintaining hot offset resistance.

<<Release Agent>>

The release agent may be appropriately selected from release agents known in the art depending on the intended purpose without any limitation. The release agent is preferably wax.

The release agent is preferably a release agent that is dissolved in an organic solvent.

Examples of the release agent include: aliphatic hydrocarbon-based wax, such as low-molecular-weight polyethylene, low-molecular-weight polypropylene, polyolefin wax, microcrystalline wax, paraffin wax, and Sasol wax; oxides of aliphatic hydrocarbon-based wax (e.g., polyethylene oxide wax) or block copolymers thereof; vegetable wax, such as candelilla wax, carnauba wax, Japan wax, and jojoba wax; animal wax, such as bees wax, lanolin, and spermaceti; mineral wax, such as ozokelite, ceresin, and petrolatum; wax including fatty acid ester as a main component, such as montanic acid ester wax and castor wax; and various synthetic ester wax and synthetic amide wax.

Other examples of the release agent include: saturated straight-chain fatty acids, such as palmitic acid, stearic acid, montanic acid, and other straight-chain alkyl carboxylic acids each having a straight-chain alkyl group; unsaturated fatty acids, such as pyrazinoic acid, eleostearic acid, and parinaric acid; saturated alcohol, such as stearyl alcohol, eicosyl alcohol, behenyl alcohol, carnauba wax alcohol, ceryl alcohol, melissyl alcohol, and other long-chain alkyl alcohols; multivalent alcohols, such as sorbitol; fatty acid amide, such as linoleic acid amide, olefinic acid amide, and lauric acid amide; saturated fatty acid bisamide, such as methylene biscapric acid amide, ethylene bislauric acid amide, and hexamethylene bisstearic acid amide; unsaturated fatty acid amide, such as ethylene bisoleic acid amide, hexamethylene bisoleic acid amide, N,N'-dioleyladipic acid amide, and N,N'-dioleylsebacic acid amide; aromatic bisamide, such as m-xylene bisstearic acid amide, and N,N-distearylisophthalic acid amide; fatty acid metal salts, such as calcium stearate, calcium laurate, zinc stearate, and magnesium stearate; graft wax prepared by grafting a vinyl-based monomer, such as styrene and acrylic acid onto aliphatic hydrocarbon-based wax; partially esterificated compound between fatty acid and multivalent alcohol, such as behenic acid monoglyceride; and methyl ester compounds each including a hydroxyl group obtained through hydrogenation of vegetable oils and fats.

In the present disclosure, the release agent is preferably ester wax including fatty acid ester as a main component or amide wax. In the case where the release agent is ester wax including fatty acid ester as a main component, particularly, an embodiment that a polyester resin is used as a binder resin and the polyester resin is used in combination with the ester wax as the release agent is more preferable.

Moreover, a product obtained by making a molecular weight distribution of any of the above-listed wax sharp through a press sweat method, a solvent method, a recrystallization method, a vacuum distillation method, a supercritical gas extraction method, or a solution crystallization method, a low-molecular-weight solid fatty acid, low-molecular-weight solid alcohol, a low-molecular-weight solid compound, and others from which impurities are removed are also preferably used as the release agent.

In the present disclosure, it is important to consider an amount of the release agent in order to obtain desirable particle diameters and shapes of the toner. In the present disclosure, an amount (W) of the release agent extracted with n-hexane is preferably from 5 mg through 30 mg per 1.0 g of the toner. The amount (W) of the release agent being in the preferable range has an advantage that the following adverse effects can be prevented.

Adverse effect that release properties are deteriorated because an amount of a release agent on a surface of the toner is insufficient and offset properties including low-temperature fixability are adversely affected.

Adverse effect that an amount of a release agent on the surface is excessive, leading to deterioration of an image due to spent of the release agent on a carrier, or poor transfer properties due to increased adhesion force.

A measurement of the extracted amount of the release agent can be performed by the following method. The amount of the release agent is not particularly limited and may be appropriately selected depending on the intended purpose, as long as a value of W is within the desired range. The amount of the release agent is preferably from 4 parts by mass through 30 parts by mass and more preferably from 4 parts by mass through 17 parts by mass relative to 100 parts by mass of the binder resin.

An amount of the wax, which is the release agent, extracted using n-hexane is measured by the following method.

The measurement of the wax extraction amount is performed according to the following manner using the predetermined amounts presented in Table 1 as standards.

TABLE 1

| | Set value | Tolerance |
|---|---|---|
| Predetermined value 1 | 1.00 g | +0.01 g, −0.00 g |
| Predetermined value 2 | 4.60 g | +0.03 g, −0.00 g |
| Predetermined value 3 | Scale: 5 | — |
| Predetermined value 4 | 1 min | — |
| Predetermined value 5 | 4,000 rpm, 1 sec | — |
| Predetermined value 6 | 3.00 g | +0.02 g, −0.00 g |
| Predetermined value 7 | 0.02 MPa | — |
| Predetermined value 8 | 2 min | — |

1) Hexane is weighed and collected in a centrifuge tube by an amount (Predetermined value 2) by means of Dispensette.

2) A toner is weighed and collected on paper for wrapping powder medicine by an amount (Predetermined value 1) by means of a scale.

3) The toner is added into the centrifuge tube using a test tube stand and the centrifuge tube is sealed with a cap.

4) Stirring is performed with setting the scale of Vortex mixer to Predetermined value 3 and setting the stirring duration to Predetermined value 4.

5) The centrifuge tube is set in a centrifuge, and the rotational speed and retention time are set to Predetermined value 5 to precipitate the toner.

6) An aluminium cup with a handle is weighed and the measured value (X) is recorded.

7) The supernatant liquid is added to the aluminium cup with the handle by Predetermined value 6 and then is placed in a vacuum drier of 150° C.

8) A scale of pressure of the vacuum dried is set to Predetermined value 7. Wait for 5 minutes until hexane is evaporated.

9) The aluminium cup with the handle is taken out from the vacuum dried and then is placed in a desiccator to cool for the duration of Predetermined value 8.

10) The aluminium cup with the handle is weighed and the measured value (Y) is recorded.

11) Wax extraction amount (mg)=(weight of aluminium cup (Y)−weight of aluminium cup (X))×1,000×4.6/3 (Formula 6)

The extracted amount of the wax is determined by (Formula 6) above.

<<Silica>>

A certain amount of the silica is preferably present being exposed to a surface of a toner base particle as well as being capsulated in the toner base particle.

The silica exposed to the surface can improve toner flowability and can give a high charging ability.

When silica including a hydroxyl group is used as the silica and a cationic surfactant is used as the charge controlling agent, moreover, hydroxyl groups of surfaces of inorganic particles exposed to a toner surface and the charge controlling agent form an ionic bond or physisorption, and the higher charge rising properties and charging amount can be obtained because of the above-mentioned interaction. Therefore, an amount of the external additive added later as a charge-imparting agent can be made small, detachment of the external additive can be suppressed, and moreover, filming of the free external additive on a photoconductor or a surface of carrier can be prevented.

A surface Si amount of the toner base particle as measured by XPS is preferably from 10 atomic % through 30 atomic % and is more preferably from 10 atomic % through 20 atomic %.

When the surface Si amount is within the preferable range, there are the following advantages.

Wax spent hardly occurs.

Characteristics of a binder resin for a toner are easily exhibited.

The silica is preferably used in the form of organosol.

Examples of a method for obtaining such organosol of the silica include a method including performing a hydrophobic treatment on a dispersion liquid of hydrogel of silica synthesized by a wet method (e.g., a hydrothermal synthesis method and a sol-gel method) with a surface treating agent, and replacing water with an organic solvent, such as methyl ethyl ketone and ethyl acetate.

As a specific production method of the organosol, for example, the method disclosed in Japanese Unexamined Patent Application Publication No. 11-43319 is suitably used.

An average primary particle diameter of the silica is preferably 100 nm or smaller and more preferably from 10 nm through 50 nm.

As the silica, silica that is subjected to a surface treatment with a hydrophobing agent.

Examples of the hydrophobing agent include a silane coupling agent, a sililation agent, a silane coupling agent including a fluoroalkyl group, an organic titanate-based coupling agent, and an aluminium-based coupling agent.

Moreover, a sufficient effect can be obtained with silica to which a surface treatment has been performed using silicone oil as a hydrophobing agent.

The hydrophobicity of the silica to which the hydrophobic treatment has been performed as described above is preferably from 15% through 55% as measured according to a methanol titration method.

Use of the silica having the hydrophobicity in the above-described range can progress deformation of a toner suitably and can form appropriate convex-concave shapes on a surface of the toner to be obtained.

The hydrophobicity is determined as follows. First, a beaker is charged with 50 mL of ion-exchanged water and 0.2 g of a sample, and methanol is dripped to the resultant mixture with stirring.

Next, the external additive is gradually settled as a concentration of the methanol inside the beaker increases. At the final point when an entire amount of the external additive is settled, a mass fraction of the methanol in the mixed solution of the methanol and water is determined as hydrophobicity (%).

<<Other Ingredients>>

The toner base particles may include other ingredients, such as a colorant, a pigment disperser, and a charge controlling agent.

—Colorant—

The colorant may be appropriately selected from colorants known in the art depending on the intended purpose without any limitation. Examples of the colorant include carbon black, a nigrosine dye, iron black, naphthol yellow S, Hansa yellow (10G, 5G, G), cadmium yellow, yellow iron oxide, yellow ocher, yellow lead, titanium yellow, polyazo yellow, oil yellow, Hansa yellow (GR, A, RN, R), Pigment Yellow L, benzidine yellow (G, GR), permanent yellow (NCG), Vulcan fast yellow (5G, R), tartrazine lake, quinoline yellow lake, anthrasan yellow BGL, isoindolinon yellow, red iron oxide, red lead, minium, cadmium red, cadmium mercury red, antimony vermilion, permanent red 4R, parared, fiser red, parachloroorthonitro aniline red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubin GX, permanent red FSR, brilliant carmine 6B, Pigment Scarlet 3B, Bordeaux 5B, toluidine Maroon, Permanent Bordeaux F2K, Helio Bordeaux BL, Bordeaux 10B, BON maroon light, BON maroon medium, eosin lake, rhodamine lake B, rhodamine lake Y, alizarin lake, thioindigo red B, thioincligo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS, BC), indigo, ultramarine, iron blue, anthraquinone blue, fast violet B, methylviolet lake, cobalt purple, manganese violet, dioxane violet, anthraquinone violet, chrome green, zinc green, chromium oxide, viridian, emerald green, Pigment Green B, naphthol green B, green gold, acid green lake, malachite green lake, phthalocyanine green, anthraquinone green, titanium oxide, zinc flower, lithopone, and mixtures of any of the above-listed colorants.

An amount of the colorant is not particularly limited and may be appropriately selected depending on the intended purpose. The amount of the colorant is preferably from 1% by mass through 15% by mass and more preferably from 3% by mass through 10% by mass.

The colorant may be used in the form of a master batch in which the colorant and a resin form a composite.

The master batch can be obtained by applying high shear force to a resin for a master batch and the colorant to mix and knead the resin and the colorant.

<<<Pigment Disperser>>>

The colorant may be used in the form of a colorant dispersion liquid in which the colorant is dispersed with a pigment disperser.

The pigment disperser may be appropriately selected from pigment dispersers known in the art depending on the intended purpose without any limitation. In view of dispersibility of a pigment, the pigment disperser is preferably a pigment disperser having high compatibility with the binder resin. Examples of commercial product of such a pigment disperser include "AJISPER PB821" and "AJISPER PB822" (available from Ajinomoto Fine-Techno Co., Ltd.), "Disperbyk-2001" (available from Japan KK), and "EFKA-4010" (available from EFKA).

An amount of the pigment disperser added is not particularly limited and may be appropriately selected depending on the intended purpose. The amount of the pigment disperser is preferably from 1 part by mass through 200 parts by mass and more preferably from 5 parts by mass through 80 parts by mass relative to 100 parts by mass of the colorant. When the amount of the colorant disperser is less than 1 part by mass, dispersibility may be low. When the amount of the colorant disperser is greater than 200 parts by mass, charging ability may be low.

—Charge Controlling Agent—

The charge controlling agent may be appropriately selected from charge controlling agents known in the art depending on the intended purpose without any limitation. Examples of the charge controlling agent include nigrosine-based dyes, triphenylmethane-based dyes, chrome-containing metal complex dyes, molybdic acid chelate pigments, rhodamine-based dyes, alkoxy-based amines, quaternary ammonium salts (including fluorine-modified quaternary ammonium salts), alkyl amides, phosphorous or phosphorus compounds, tungsten or tungsten compounds, fluorine-based active agents, salicylic acid metal salts, and metal salts of salicylic acid derivatives.

An amount of the charge controlling agent used is not particularly limited and may be appropriately selected depending on a type of the binder resin, the presence of additives used optionally, and a toner production method including a dispersion method. The amount of the charge controlling agent is preferably from 0.1 parts by mass through 10 parts by mass and more preferably from 0.2 parts by mass through 5 parts by mass relative to 100 parts by mass of the binder resin.

The above-listed charge controlling agents are preferably soluble to an organic solvent in view of production stability, but the charge controlling agents may be added by finely dispersing in an organic solvent by means of a bead mill etc.

—Flowability-Improving Agent

A flowability-improving agent may be added to the toner according to the present disclosure. The flowability-improving agent is added to a surface of a toner to improve flowability (facilitate flow) of the toner.

Particles diameters of the flowability-improving agent is not particularly limited and may be appropriately selected depending on the intended purpose. As the particle diameters, an average primary particle diameter of the flowability-improving agent is preferably from 0.001 μm through 2 μm and more preferably from 0.002 μm through 0.2 μm.

A number average particle diameter of the flowability-improving agent is not particularly limited and may be appropriately selected depending on the intended purpose. The number average particle diameter is preferably from 5 nm through 100 nm and more preferably from 5 nm through 50 nm.

An appropriate amount of the flowability-improving agent is not particularly limited and may be appropriately selected depending on the intended purpose. The appropriate amount is preferably from 0.03 parts by mass through 8 parts by mass relative to 100 parts by mass of the toner particles.

—Cleaning-Improving Agent—

A cleaning-improving agent configured to improve removability of a toner remained on an electrostatic latent image bearer or a primary transfer medium after transferring the toner on recording paper etc. is not particularly limited and may be appropriately selected depending on the intended purpose. Examples of the cleaning-improving agent include: fatty acid (e.g. stearic acid) metal salts, such as zinc stearate and calcium stearate; and polymer particles produced by soap-free emulsion polymerization, such as polymethyl methacrylate particles and polystyrene particles. The polymer particles are preferably polymer particles having a relatively narrow particle size distribution and having a weight average particle diameter of from 0.01 μm through 1 μm.

<External Additive>

As the external additive, inorganic particles or hydrophobic-treated inorganic particles may be used in combination with oxide particles. An average particle diameter of hydrophobic-treated primary particles is preferably from 1 nm through 100 nm and more preferably from 5 nm through 70 nm.

Moreover, the external additive preferably includes at least one type of hydrophobic-treated inorganic particles having an average primary particle diameter of 20 nm or smaller and at least one type of hydrophobic-treated inorganic particles having an average primary particle diameter of 30 nm or greater. Moreover, a specific surface area of the external additive according to the BET method is preferably from 20 $m^2/g$ through 500 $m^2/g$.

The external additive is not particularly limited and may be appropriately selected depending on the intended purpose. Examples of the external additive include silica particles, hydrophobic silica, fatty acid metal salts (e.g., zinc stearate and aluminium stearate), metal oxides (e.g., titania, alumina, tin oxide, and antimony oxide), and fluoropolymers.

Examples of preferable additives include hydrophobic silica, titania, titanium oxide, and alumina particles. Examples of the silica particles include R972, R974, RX200, RY200, R202, R805, and R812 (all available from NIPPON AEROSIL CO., LTD.). Moreover, examples of the titania particles include: P-25 (available from NIPPON AEROSIL CO., LTD.): STT-30 and STT-65C-S(both available from Titan Kogyo, Ltd.); TAF-140 (available from Fuji Titanium Industry Co., Ltd.); and MT-150 W, MT-500B, MT-600B, and MT-150A (available from TAYCA CORPORATION).

Examples of the hydrophobic-treated titanium oxide particles include: T-805 (available from NIPPON AEROSIL CO., LTD.); STT-30A and STT-65S-S(both available from Titan Kogyo, Ltd.); TAF-500T and TAF-1500T (both available from Fuji Titanium Industry Co., Ltd.); MT-100S and MT-100T (both available from TAYCA CORPORATION); and IT-S(available from ISHIHARA SANGYO KAISHA, LTD.).

For example, the hydrophobic-treated oxide particles, the hydrophobic-treated silica particles, the hydrophobic-treated titania particles, and the hydrophobic-treated alumina particles can be treated by treating hydrophilic particles with a silane coupling agent, such as methyltrimethoxysilane, methyltriethoxysilane, and octyltrimethoxysilane. Moreover, silicone oil-treated oxide particles or inorganic particles obtained by treating inorganic particles with silicon oil with applying heat if necessary are also preferable.

Examples of the silicone oil include dimethyl silicone oil, methylphenyl silicone oil, chlorophenyl silicone oil, methylhydrogen silicone oil, alkyl-modified silicone oil, fluorine-modified silicone oil, polyether-modified silicone oil, alcohol-modified silicone oil, amino-modified silicone oil, epoxy-modified silicone oil, epoxy/polyether-modified silicone oil, phenol-modified silicone oil, carboxyl-modified silicone oil, mercapto-modified silicone oil, methacryl-modified silicone oil, and α-methylstyrene-modified silicone oil.

Examples of the inorganic particles include silica, alumina, titanium oxide, barium titanate, magnesium titanate, calcium titanate, strontium titanate, iron oxide, copper oxide, zinc oxide, tin oxide, quartz sand, clay, mica, wollastonite, diatomaceous earth, chromic oxide, cerium oxide, red iron oxide, antimony trioxide, magnesium oxide, zirconium oxide, barium sulfate, barium carbonate, calcium carbonate, silicon carbide, and silicon nitride. Among the above-listed examples, silica and titanium dioxide are particularly preferable.

An amount of the external additive is not particularly limited and may be appropriately selected depending on the intended purpose. The amount of the external additive is preferably from 0.1 parts by mass through 5 parts by mass and more preferably from 0.3 parts by mass through 3 parts by mass relative to 100 parts by mass of the toner.

An average particle diameter of primary particles of the inorganic particles is not particularly limited and may be appropriately selected depending on the intended purpose. The average particle diameter is preferably 100 nm or smaller and more preferably 3 nm or greater but 70 nm or smaller.

<Properties of Toner>

<<Method for Removing External Additive from Toner Particles>>

Removal of the external additive from a surface of the toner is performed in the following manner.

To a 0.5% surfactant (Noigen ET-165, available from DKS Co., Ltd.) aqueous solution, 3.75 g of the toner is added. The resultant is stirred for 30 minutes at the rotational speed by which foaming does not occur, to thereby prepare Toner Dispersion Liquid A. Ultrasonic waves (height of ultrasonic weight vibration section from base: 1.0 cm, strength: 40 W, 5 minutes) are applied to Toner Dispersion Liquid A by means of an ultrasonic homogenizer (VCX750, Sonics & Materials, Inc.), to thereby prepare Toner Dispersion Liquid B. Toner Dispersion Liquid B is transferred into a centrifuge tube and centrifuge is performed for 2 minutes at 2,000 rpm. After the centrifuge, the supernatant liquid is discarded, 60 mL of pure water is added to the precipitated toner to form a dispersion slurry, and vacuum filtration is performed (Filtration paper for Kirishima Rohto No. 5C, 60 φm/m, available from Kirishima Glass Works Co.). The toner remained on the filtration paper is formed into a dispersion slurry with 60 mL of pure water, then vacuum filtration is performed to wash the toner. The toner remained on the filtration paper is collected and the collected toner is dried for 8 hours in a constant temperature chamber of 40° C., to thereby obtain toner base particles.

Note that, the above-described method for removing the external additive can applied to not only a case where the external additive is inorganic particles, but also a case where the external additive is organic resin particles.

<<Silicon Atom Concentration>>

A concentration of silicon atoms present on surfaces of the toner base particles (surface Si amount) can be measured by X-ray photoelectron spectroscopy (XPS).

Note that, the toner surface means a region of a top surface, which is about several nanometers within the toner surface.

For the measurement of the silicon atom concentration, 1600S-type X-ray photoelectron spectrometer available from PHI is used, an X-ray source is MgKα (400 W), and an analysis region is 0.8 mm×2.0 mm.

Note that, as a pretreatment, an aluminium dish is packed with a sample, and is adhered to a sample holder with a carbon sheet.

For calculation of the surface atom concentration, a relative sensitivity factor provided by PHI is used.

<<Average Primary Particle Diameter of Silica>>

An average primary particle diameter of the silica, which is detected from a transmission electron microscopic (TEM) photograph of a cracked surface of the toner base particle, is preferably from 10 nm through 50 nm. The average primary particle diameter can be determined based on the transmission electron microscopic (TEM) photograph of the cracked surface of the toner base particle.

A specific measuring method is described as follows.

For example, a toner is embedded in an epoxy resin, and the epoxy resin is sliced by an ultramicrotome (ultrasonic) to produce a thin slice. A cracked surface of the toner base particle on the thin slice is observed under a transmission electron microscope (TEM) by enlarging a field of view of the microscope until a particle diameter of silica present on the toner base particle can be measured from the cracked surface of the toner with adjusting a magnification of the microscope, to extract arbitrarily selected 3 cracked surfaces of the toner as samples for measurement. At the time of the observation, silica in the toner may be enhanced by dying using ruthenium or osmium to enhance the contrast, if necessary. After measuring particle diameters of 10 silica particles per toner particle, an average value of 30 particles in total is determined.

<<Toner Average Circularity>>

An average circularity of the toner is not particularly limited and may be appropriately selected depending on the intended purpose. The average circularity is preferably from 0.970 through 0.985.

In the present disclosure, the average circularity can be measured by means of a flow particle image analyzer FPIA-3000, available from SYSMEX CORPORATION under the following analysis conditions.

<Analysis Conditions>

Condition 1, limits of particle diameters: 1.985 μm≤equivalent circle diameter (number base)<200.0 μm Condition 2, limits of particle shapes: 0.200≤circularity≤1.000

Condition 3, limits of the number of particles (the number of particles satisfying Conditions 1 and 2): 4,800 particles or greater but 5,200 particles or less The outline of FPIA-3000 will be explained.

FPIA-3000 is a device configured to measure a particle image according to the imaging flow cytometry method to analyze the particles. A sample dispersion liquid is passed through a channel (widens along the direction of the flow) of a flat and transparent flow cell (thickness: about 200 μm). In order to form a light path passing through with crossing the thickness of the flow cell, a strobe and a CCD camera are disposed opposite to each other with the flow cell being in between. While the sample dispersion liquid is passing through, strobe light is emitted at intervals of 1/60 seconds to obtain images of particles passing through the flow cell. As a result, each of the particles is taken as a two-dimensional image having a parallel constant range in the flow cell. A diameter of a circle having the same area is calculated as an equivalent circle diameter (Dv, Dn) from the area of the two-dimensional image of each particle. Moreover, the circularity is calculated as a ratio between a circumferential length (l) obtained from the two-dimensional image of the particle and a circumferential length (L) of a circle having the same area to the area of the particle.

$$\text{Circularity}=(L)/(l)$$

The closer the value of the circularity to 1 is, more spherical a shape of the particle is.

When a measurement is performed by means of the measuring device above with setting the above-mentioned analysis conditions, an average circularity Rave., a particle modal diameter (number-base) θmax, a ratio of particles having particle diameters of 0.75×θmax or less and having circularity of 0.980 or greater to the limits of the number of the particles, and a standard deviation of the number count value are calculated under the analysis conditions above, and these measurement results can be obtained.

Measurement targets of the limits of the number of particles are particles satisfying Condition 1 and Condition 2, and the limits of the number of particles indicate a value obtained by counting the number of particles that are the targets. However, a concentration of the sample dispersion liquid is adjusted in a manner that the measuring number is to be within a range of 4,800 particles or greater but 5,200 particles or less.

<<Toner Particle Diameter>>

A volume average particle diameter of the toner of the present disclosure is preferably from 1 μm through 8 μm in view of formation of an image of high resolution, high definition, and high quality. Moreover, a particle size distribution (volume average particle diameter/number average particle diameter) of the toner is preferably from 1.00 through 1.15 in view of stable maintenance of an image over a long period.

Moreover, the toner of the present disclosure preferably has a second frequency (number) peak within a range of number particles that are from 1.21 times through 1.31 times the most frequent (number) number particle (also referred to as "modal diameter") in a distribution, in which a number particle diameter and frequency (number) of the toner are plotted. When the second frequency (number) does not appear, particularly in the case where the particle size distribution (volume average particle diameter/number average particle diameter) is close to 1.00 (monodisperse), close-packability of the toner becomes extremely high and therefore initial flowability tends to be low or cleaning failures tend to occur. When the second frequency (number) peak is present at a number particle diameter larger than 1.31 times, moreover, an image quality graininess is poor because a large amount of coarse powder is included as a toner and therefore it is not preferable.

FIG. 1 is a graph illustrating one example of a distribution in which a number average particle diameter and frequency (number) of the toner of the present disclosure are plotted. In FIG. 1, the horizontal axis indicates a number average particle diameter (μm) and the vertical axis indicates frequency (number). The graph indicates that a second frequent (number) peak is present within number average particle diameters that are from 1.21 through 1.31 times the most frequent (number) number particle diameter (also referred to as a "modal diameter").

Measurements of particle diameters and particle size distribution are performed in the following manner.

[Measurements of Particle Diameter and Particle Size Distribution of Toner]

A volume average particle diameter (Dv) and number average particle diameter (Dn) of the toner of the present disclosure are measured by means of a particle size measuring device ("Multisizer III," available from Beckman Coulter, Inc.) with an aperture diameter of 50 μm. After measuring the volume and the number of toner particles, a volume distribution and a number distribution are calculated. The volume average particle diameter (Dv) and number average particle diameter (Dn) of the toner can be determined from the obtained distributions. As the particle size distribution, used is Dv/Dn that is a value obtained by dividing the volume average particle diameter (Dv) of the toner with the number average particle diameter (Dn) of the toner. When the toner particles are completely monodisperse particles, the value of the particle size distribution is 1. The larger value of the particle size distribution means the wider particle size distribution.

<Glass Transition Temperature of Toner>

A glass transition temperature of the toner is preferably 55° C. or higher but 75° C. or lower and more preferably 60° C. or higher but 70° C. or lower in order to obtain both low-temperature fixability and hot offset resistance.

The glass transition temperature is a glass transition temperature [Tg1st (toner)] for the first heating of differential scanning calorimetry (DSC).

For example, the glass transition temperature can be measured by means of a DSC system (differential scanning calorimeter) ("Q-200," available from TA Instruments).

Specifically, a glass transition temperature of a target sample can be measured in the following manner.

First, a sample container formed of aluminium is charged with about 5.0 mg of a target sample, the sample container is placed on a holder unit, and the holder unit is set in an electric furnace. Subsequently, the sample is heated in a nitrogen atmosphere from −80° C. to 150° C. at a heating rate of 10° C./min (first heating). Thereafter, the sample is cooled from 150° C. to −80° C. at a cooling rate of 10° C./min. Then, the sample is heated to 150° C. at a heating rate of 10° C./min (second heating). A DSC curve is measured for each of the first heating and the second heating by means of a differential scanning calorimeter ("Q-200," available from TA Instruments).

A DSC curve for the first heating is selected from the obtained DSC curves using an analysis program installed in the Q-200 system to determine a glass transition temperature of the target sample for the first heating. Moreover, a DSC curve for the second heating is selected in the same manner to determine a glass transition temperature of the target sample for the second heating.

<Production Method of Toner>

One example of a production method of the toner of the present disclosure will be explained hereinafter. The toner producing unit of the present disclosure is divided into a droplet adjusting unit, a droplet-ejecting unit, a droplet conveying and solidifying unit, and a droplet collecting unit. Each unit will be described below.

<<Droplet Adjusting Unit>>

The droplet forming unit is a unit configured to eject a toner composition liquid to form droplets, where the toner composition liquid is obtained by dissolving or dispersing, in an organic solvent, at least a binder resin, a release agent, and silica.

The toner composition liquid can be obtained by dissolving or dispersing a toner composition in an organic solvent, where the toner composition includes at least the binder resin, the release agent, and the silica and may further include other components, such as a colorant, a pigment disperser, and a charge controlling agent, according to the necessity.

The organic solvent is not particularly limited and may be appropriately selected depending on the intended purpose, as long as the organic solvent is a volatile organic solvent capable of dissolving or dispersing the toner composition in the toner composition liquid and capable of dissolving the binder resin and the release agent in the toner composition liquid without causing phase separation. As the organic solvent, ether-based organic solvents, ketone-based organic solvents, hydrocarbon-based organic solvents, and alcohol-based organic solvents are preferably used. Particularly, tetrahydrofuran (THF), acetone, methyl ethyl ketone (MEK), ethyl acetate, toluene, water, etc. are listed as the organic solvent. The above-listed examples may be used alone or in combination.

In the case where ethyl acetate is used as the organic solvent in the present disclosure, as described earlier, preferably used is a release agent that is dissolved in an amount of 70 g or grater, more preferably 200 g or greater in 100 g of ethyl acetate of 45° C.

—Preparation Method of Toner Composition Liquid—

A toner composition liquid can be obtained by dissolving or dispersing the toner composition in an organic solvent. In order to prevent clogging of an ejection hole, it is important in the preparation of the toner composition liquid that dispersed elements, such as a colorant, are sufficiently finely dispersed relative to an opening diameter of a nozzle by means of a homomixer or a bead mill.

A solid content of the toner composition liquid is preferably from 3% by mass through 40% by mass.

A step for ejecting the toner composition liquid to form droplets can be performed by ejecting droplets using a droplet-ejecting unit.

Moreover, a liquid temperature of the toner composition liquid is preferably from about 50° C. through about 60° C.

<<Droplet-Ejecting Unit>>

A droplet-ejecting unit for use in the present disclosure is not particularly limited as long as the droplet-ejecting unit ejects droplets having a narrow particle diameter distribution. As the droplet-ejecting unit, any of droplet-ejecting units known in the art can be used. Examples of the droplet-ejecting unit include 1-fluid nozzles, 2-fluid nozzles, membrane-vibration ejecting units, Rayleigh-breakup ejecting units, liquid-vibration ejecting units, and liquid-column-resonance ejecting units. Examples of the membrane-vibration ejecting units are disclosed in Japanese Patent No. 5055154. Examples of the Rayleigh-breakup ejecting units are disclosed in Japanese Patent No. 4647506. Examples of the liquid-vibration ejecting units are disclosed in Japanese Patent No. 5315920. Examples of the liquid-column-resonance ejecting units are disclosed in Japanese Unexamined Patent Application Publication No. 2011-212668.

In order to make a particle diameter distribution of droplets narrow and assure productivity of the toner, droplet formation through liquid column resonance can be preferably used. In the droplet formation through liquid column resonance, vibrations are applied to a liquid in a liquid-column-resonance liquid chamber, in which a plurality of ejection holes are formed, to form standing waves due to liquid column resonance, and the liquid may be ejected from the ejection holes formed in regions that are the bellies of the standing waves. Any of the above-described methods is preferably used.

—Liquid-Column-Resonance Ejecting Unit—

A liquid-column-resonance ejecting unit configured to eject utilizing resonance of liquid columns is described.

Figure 2:
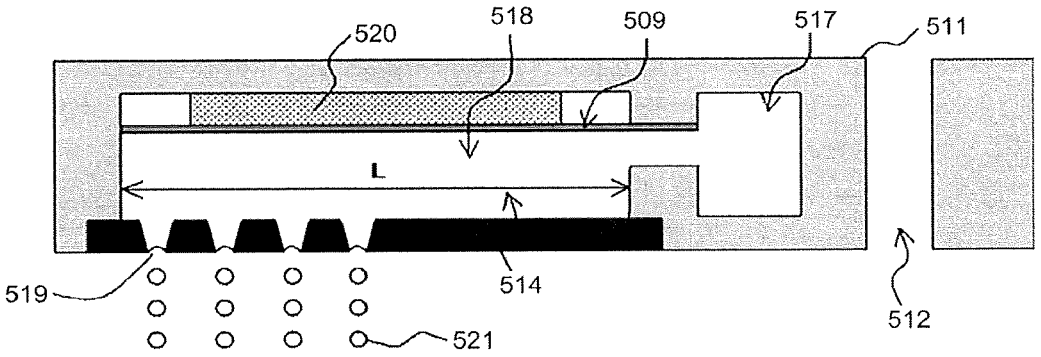
FIG. 2 is a cross-sectional view illustrating one example of a liquid-column-resonance droplet-ejecting unit.

The liquid-column-resonance droplet-ejecting unit 511 illustrated in FIG. 2 includes a liquid common supply channel 517 and a liquid-column-resonance liquid chamber 518. The liquid-column-resonance liquid chamber 518 is communicated with the liquid common supply channel 517 formed in one wall surface among wall surfaces of the both edges in the longitudinal direction. Moreover, the liquid-column-resonance liquid chamber 518 has ejection holes 519 that are formed in one wall surface among wall surfaces connected to the wall surfaces of the both edges, where droplets 521 are ejected from the ejection holes 519, and a vibration-generating unit 520 that is formed in a wall surface facing to the ejection holes 519 and is configured to generate high frequency vibrations for forming liquid column resonance standing waves. Note that, a high frequency power supply that is not illustrated is coupled with the vibration-generating unit 520. In FIG. 2, the reference numeral 509 represents an elastic plate, the reference numeral 512 represents a flow channel, and the reference numeral 514 represents a toner composition liquid.

As a liquid to be ejected from the ejecting unit in the present disclosure, a toner component liquid 514 (in order to describe a case of production of a toner, the liquid is described as the "toner component liquid") that is a state where a component of particles to be obtained is dissolved or dispersed is flown into the liquid common supply channel 517 via a liquid supply pipe by a liquid circulation pump that is not illustrated to supply the toner component liquid 514 to the liquid-column-resonance liquid chamber 518. Inside the liquid-column-resonance liquid chamber 518 charged with the toner component liquid 514, a pressure distribution is formed by liquid column resonance standing waves generated by the vibration-generating 520. Then, droplets 521 are ejected from the ejection holes 519 disposed in the regions that are bellies of the standing waves that are areas having large amplitudes in the liquid column resonance standing waves and large pressure variations. The regions that are bellies of the standing waves of liquid column resonance mean the regions other than sections of the standing waves. The regions are preferably regions that have amplitudes with which the pressure variations of the standing waves are large enough to eject the liquid. The regions are more preferably regions that are ±¼ a wavelength from the portions at which the amplitudes of the pressure standing waves become maximum (sections as speed standing waves) towards the positions at which the amplitudes become minimum. As long as the location is in the regions that are bellies of the standing waves, substantially uniform droplets can be formed from ejection holes, even when a plurality of the ejection holes are disposed, and moreover ejection of droplets can be performed efficiently, and therefore clogging of the ejection holes are not easily caused. Note that, the toner component liquid 514 passed through the liquid common supply channel 517 is returned back to a raw material container via a liquid return tube that is not illustrated. When an amount of the toner component liquid 514 inside the liquid-column-resonance liquid chamber 518 is reduced by ejection of the droplets 521, a suction force due to the actions of the liquid column resonance standing waves inside the liquid-column-resonance liquid chamber 518 is worked to increase a flow rate of the toner component liquid 514 supplied from the liquid common supply channel 517 to thereby supply the toner component liquid 514 into the liquid-column-resonance liquid chamber 518. When the toner component liquid 514 is supplied into the liquid-column-resonance liquid chamber 518, the flow rate of the toner component liquid 514 passing through the liquid common supply channel 517 is returned back to the original flow rate.

<<Droplet-Solidifying Unit>>

A toner of the present disclosure can be obtained by transporting droplets of a toner component liquid ejected from the above-described droplet-ejecting unit into the air (droplet conveying unit), solidifying the droplets (droplet-solidifying unit), and then collecting the solidified droplets. As the droplet conveying unit and the droplet-solidifying unit, the same unit may be used to solidify the droplet while conveying the droplets. The droplet conveying unit may convey the droplets to a droplet collecting unit after solidifying the droplets. Alternatively, the droplets may be solidified after being collected.

<<Flow Temperature Adjusting Unit and Flow Temperature Adjusting Step>>

A flow temperature adjusting step is not particularly limited and may be appropriately selected depending on the intended purpose as long as the flow temperature adjusting step is a step capable of adjusting a conveyance flow temperature in a droplet conveying unit. The flow temperature adjusting step preferably uses a flow temperature adjusting unit.

<<Solidified-Particle Collecting Unit>>

The solidified particles can be collected from the air by any of powder collecting unit is known in the art, such as cyclone collector and a back filter.

<<Secondary Drying>>

When an amount of a residual solvent included in the toner particles obtained by the dry collecting unit is large, secondary drying is performed according to the necessity in order to reduce the amount of the residual solvent. For the secondary drying, typical drying units known in the art, such as fluidized-bed drying and vacuum drying, can be used. When the organic solvent is remained in the toner, not only changing toner properties, such as heat resistant storage stability, fixability, and charging properties, over time, but also users and peripheral devices may be adversely affected because the organic solvent is evaporated by heat applied during the fixing. Therefore, sufficient drying is performed.

Figure 3:
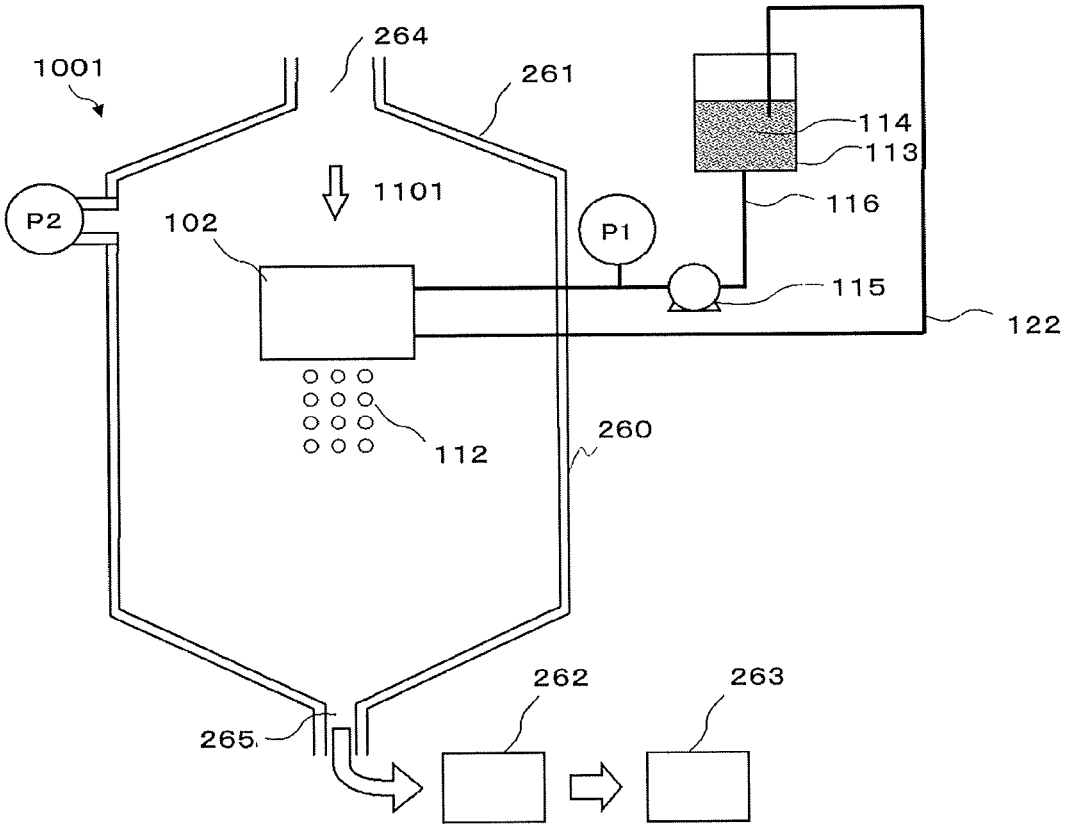
FIG. 3 is a schematic view illustrating one example of a production device of the toner of the present disclosure.

One example of a toner production device is illustrated in FIG. 3.

Mainly, a toner production device 1001 includes a droplet-ejecting unit 102 and a drying and collecting unit 260. The droplet-ejecting unit 102 is coupled with a raw material stored container 113 configured to store a toner component liquid 114, and a liquid circulation pump 115 configured to supply the toner component liquid 114 stored in the raw material stored container 113 to the droplet-ejecting unit 102 via a liquid supply pipe 116 and to pressure feed the toner component liquid 114 inside the liquid supply pipe 116 back to the raw material stored container 113 via a liquid return pipe 122. Therefore, the toner component liquid 114 can be supplied to the droplet-ejecting unit 102 at any time. A pressure gauge P1 is disposed to the liquid supply pipe 116 and a pressure gauge P2 is disposed to the drying and collecting unit. The feeding pressure to the droplet-ejecting unit 102 and the pressure inside the drying and collecting unit 260 are controlled by the pressure gauges P1 and P2. When the relationship of the pressure is P1>P2, the toner component liquid 114 may be bled out from pores. In the case of P1<P2, gas may be included in the ejection unit and ejection may be stopped. Therefore, the relationship of the pressure is ideally P1≈P2.

Inside the chamber 261, a conveyance airflow 1101 created from a conveyance airflow inlet 264 is formed. The droplets 112 ejected from the droplet-ejecting unit 102 are transported downwards, not only by gravity, but also by the transport airflow 1101, and then are collected by a solid particle-collecting unit 262.

If jetted droplets are brought into contact with one another before drying, droplets are combined to form one particle (this phenomenon is referred to as coalescence hereinafter). In order to obtain solidified particles having a uniform particle diameter distribution, it is necessary to keep a distance between jetted droplets. The jetted droplets have certain initial speed but eventually lose the speed due to air resistance. Droplets jetted later chatch up with the slowed particles, and as a result, coalescence occurs. This phenomenon occurs constantly. Therefore, a particle diameter distribution significantly deteriorates if such particles are collected. In order to prevent coalescence, it is necessary to prevent the speed loss of the droplets and to convey the droplets with solidifying while preventing coalescence in a manner that the droplets are prevented from being in contact with each other by the conveying airflow 1101. Eventually, the solidified particles are transported to the solidified particle collecting unit 262.

For example, part of the conveying airflow 1101 is arranged near the droplet-ejecting unit 102 to be an identical direction to the droplet ejecting direction to thereby prevent the speed loss of the droplets just after ejecting the droplets to prevent coalescence. Alternatively, the direction of the conveying airflow may be the cross direction relative to the ejecting direction. The direction of the conveying airflow may be angled. The direction of the conveying airflow is preferably angled in a manner that droplets come away from the droplet-ejecting unit. In the case where the coalescence-prevention airflow is supplied from the cross direction relative to ejection of droplets, the direction of the airflow is preferably the direction in which trajectories are not overlapped when droplets are conveyed by the coalescence-prevention airflow from ejection holes.

After preventing coalescence by the first airflow as described above, the solidified particles may be transported to the solidified particle collecting unit by a second airflow.

The speed of the first airflow is preferably identical or faster than the speed for jetting droplets. When the speed of the coalescence-prevention airflow is slower than the speed for jetting droplets, it is difficult to exhibit the function of preventing contact between droplet particles, which is the original object of the coalescence-prevention airflow.

As properties of the first airflow, conditions under which coalescence of droplets do not occur can be added. The properties of the first air flow may not be identical to properties of the second air flow. Moreover, a chemical substance that accelerates solidification of surfaces of particles may be mixed into the coalescence-prevention airflow, or the coalescence-prevention airflow may be applied for expecting a physical effect.

A state of airflow of the conveying airflow 1101 is not particularly limited and may be laminar flow, swirling flow, or turbulence. A type of gas constituting the conveying airflow 1101 is not particularly limited. Air or incombustible gas, such as nitrogen, may be used. Moreover, a temperature of the conveying airflow 1101 can be appropriately adjusted. Ideally, the temperature does not change during production. Moreover, a unit configured to change the state of the airflow of the conveying airflow 1101 may be disposed in the chamber 261. The conveying airflow 1101 may be used for not only preventing coalescence of the droplets 112 but also preventing deposition of the droplets to the chamber 261.

(Developer)

A developer of the present disclosure includes at least the toner of the present disclosure, and may further include other ingredients, such as a carrier, depending on the intended purpose.

The toner of the present disclosure obtained in the above-described manner can be suitably used as either a one component developer or a two-component developer prepared by mixing the toner with a carrier. Since the toner of the present disclosure has improved particle strength, can prevent crushing that may be caused by a blade, and has excellent adhesion resistance, particularly, the toner can be effectively used as a one-component developer.

<Carrier>

The carrier is not particularly limited and may be appropriately selected depending on the intended purpose. Examples of the carrier include a carrier of ferrite, magnetite, etc., and a resin-coated carrier.

The resin-coated carrier includes carrier core particles, and a resin coating material that is a resin covering (coating) surfaces of the carrier core particles.

A particle diameter of the carrier is not particularly limited and may be appropriately selected depending on the intended purpose. The particle diameter is preferably from 4 μm through 200 μm, more preferably from 10 μm through 150 μm, and even more preferably from 20 μm through 100 μm. Among them, the particle diameter of the resin-coated carrier is particularly preferably a 50% particle diameter thereof being from 20 μm through 70 μm. In a two-component developer, from 1 part by mass through 200 parts by mass of the toner of the present disclosure is preferably used relative to 100 parts by mass of the carrier, and from 2 parts by mass through 50 parts by mass of the toner is more preferably used relative to 100 parts by mass of the carrier.

(Toner Stored Unit)

A toner stored unit of the present disclosure is a unit that has a function of storing a toner and stores the toner. Examples of embodiments of the toner stored unit include a toner stored container, a developing device, and a process cartridge.

The toner stored container is a container in which a toner is stored.

The developing device is a device including a unit configured to store a toner and develop.

The process cartridge is a process cartridge which includes at least an image bearer and a developing unit that are integrated, stores a toner, and is detachably mounted in an image forming apparatus. The process cartridge may further includes at least one selected from the group consisting of a charging unit, an exposing unit, and a cleaning unit.

When an image is formed by mounting the toner stored unit of the present disclosure in an image forming apparatus, image formation is performed using the toner of the present disclosure. Therefore, the toner stored unit including the toner that can obtain optimal glossiness without inhibiting low-temperature fixing ability and suppress gloss unevenness can be obtained.

(Image Forming Method and Image Forming Apparatus)

An image forming apparatus of the present disclosure includes at least an electrostatic latent image bearer (may be referred to as a "photoconductor" hereinafter), an electrostatic latent image forming unit, and a developing unit. The image forming apparatus may further include other units, such as a charge-eliminating unit, a cleaning unit, a recycling unit, and a controlling unit, according to the necessity.

An image forming method associated with the present disclosure includes at least an electrostatic latent image forming step and a developing step. The image forming method may further include other steps, such as a charge-eliminating step, a cleaning step, a recycling step, and a controlling step.

The image forming method can be suitably performed by the image forming apparatus. The electrostatic latent image forming step can be suitably performed by the electrostatic latent image forming unit. The developing step can be suitably performed by the developing unit. The above-mentioned other steps can be suitably performed by the above-mentioned other units.

—Electrostatic Latent Image Forming Step and Electrostatic Latent Image Forming Unit—

The electrostatic latent image forming step is a step including forming an electrostatic latent image on an electrostatic latent image bearer.

A material, shape, structure, size, etc., of the electrostatic latent image bearer (may be referred to as an "electrophotographic photoconductor" or a "photoconductor") are not particularly limited and may be appropriately selected from electrostatic latent image bearers known in the art. The shape thereof is dubitably a drum shape. Examples of the material thereof include; inorganic photoconductors, such as amorphous silicon and selenium; and organic photoconductors (OPC), such as polysilane and phthalopolymethine. Among the above-listed example, the organic photoconductor (OPC) is preferable because an image of higher resolution can be obtained.

For example, formation of the electrostatic latent image can be performed by uniformly charging a surface of the electrostatic latent image bearer, followed by exposing the surface to light imagewise, and can be performed by the electrostatic latent image forming unit.

For example, the electrostatic latent image forming unit includes at least a charging unit (a charger) configured to uniformly charge a surface of the electrostatic latent image bearer and an exposing unit (an exposure) configured to expose the surface of the electrostatic latent image bearer imagewise.

For example, the charging can be performed by applying voltage to a surface of the electrostatic latent image bearer using the charger.

The charger is not particularly limited and may be appropriately selected depending on the intended purpose. Examples of the charger include contact chargers, known in the art themselves, each equipped with a conductive or semiconductive roller, brush, film, or rubber blade, and non-contact chargers utilizing corona discharge, such as corotron, and scorotron.

The charger is preferably a charger that is disposed in contact with or without contact with the electrostatic latent image bearer and is configured to apply superimposed DC and AC voltage to charge a surface of the electrostatic latent image bearer.

Moreover, the charger is preferably a charger that is disposed close to the electrostatic latent image bearer via a gap tape without contacting with the electrostatic latent image bearer, and is configured to apply superimposed DC and AC voltage to the charging roller to charge a surface of the electrostatic latent image bearer.

For example, the exposure can be performed by exposing the surface of the electrostatic latent image bearer to light imagewise using the exposure.

The exposurer is not particularly limited and may be appropriately selected depending on the intended purpose, as long as the exposure is capable of exposing the charged surface of the electrostatic latent image bearer to light in the shape of an image to be formed. Examples of the exposure include various exposurers, such as copy optical exposurers, rod lens array exposurers, laser optical exposurers, and liquid crystal shutter optical exposurers.

Note that, in the present disclosure, a back-exposure system may be employed. The back-exposure system is a system where imagewise exposure is performed from the back side of the electrostatic latent image bearer.

—Developing Step and Developing Unit—

The developing step is a step including developing the electrostatic latent image with the toner to form a visible image.

For example, formation of the visible image can be performed by developing the electrostatic latent image with the toner and can be performed by the developing unit.

For example, the developing unit is preferably a developing unit that stores the toner therein and includes at least a developing device capable of applying the toner to the electrostatic latent image directly or indirectly. The developing unit is more preferably a developing device etc. equipped with a toner stored container.

The developing device may be a developing device for a single color or a developing device for multiple colors. For example, the developing device is preferably a developing device including a stirrer configured to stir the toner to cause friction to thereby charge the toner, and a rotatable magnet roller.

—Transferring Step and Transferring Unit—

The transferring step is a step including transferring the visible image to a recording medium. A preferable embodiment of the transferring step is an embodiment where an intermediate transfer member is used, the visible image is primary transferred onto the intermediate transfer member and then the visible image is secondary transferred onto the recording medium. A more preferable embodiment thereof is an embodiment using two or more colors of the toners, preferably full-color toners, and including a primary transfer step and a secondary transfer step, where the primary transfer step includes transferring visible images on the intermediate transfer member to form a composite transfer image, and the secondary transfer step includes transferring the composite transfer image onto the recording medium.

The transferring unit (the primary transferring unit and the secondary transferring unit) preferably includes at least a transferrer configured to charge and release the visible image formed on the electrostatic latent image bearer (photoconductor) to the side of the recording medium. The number of the transferring unit may be one, or two or more.

Examples of the transferrer include a corona transferer using corona discharge, a transfer belt, a transfer roller, a pressure transfer roller, and adhesion transferer.

Note that, the recording medium is not particularly limited and may be appropriately selected from recording media (recording paper) known in the art.

—Fixing Step and Fixing Unit—

The fixing step is a step including fixing the visible image transferred to the recording medium using the fixing device. The fixing step may be performed every time a visible image of each color of the developer is transferred. Alternatively, the fixing step may be performed once at the same time in a state visible images of all the colors of the developers are laminated.

The fixing device is not particularly limited and may be appropriately selected depending on the intended purpose. The fixing device is suitably any of heat pressure units known in the art. Examples of the heat pressure units include a combination of a heat roller and a pressure roller and a combination of a heat roller, a pressure roller, and an endless belt.

The charge-eliminating step is a step including applying charge elimination bias to the electrostatic latent image bearer to eliminate the charge. The charge-eliminating step can be suitably performed by the charge-eliminating unit.

The charge-eliminating unit is not particularly limited as long as the charge-eliminating unit is capable of applying charge-eliminating bias to the electrostatic latent image bearer, and may be appropriately selected from charge eliminators known in the art. For example, the charge-eliminating unit is preferably a charge-eliminating lamp etc.

The cleaning step is a step including removing the toner remained on the electrostatic latent image bearer. The cleaning step can be suitably performed by the cleaning unit.

The cleaning unit is not particularly limited as long as the cleaning unit is capable of removing the toner remained on the electrostatic latent image bearer, and may be appropriately selected from cleaners known in the art. Examples of the cleaning unit include a magnetic brush cleaner, an electrostatic brush cleaner, a magnetic roller cleaner, a blade cleaner, a brush cleaner, and a web cleaner.

The recycling step is a step including recycling the toner removed by the cleaning step to the developing unit. The recycling step can be suitably performed by the recycling unit. The recycling unit is not particularly limited and may be any of conveying units known in the art.

The controlling step is a step including controlling each of the above-mentioned steps. The controlling step can be suitably performed by the controlling unit.

The controlling unit is not particularly limited and may be appropriately selected depending on the intended purpose, as long as the controlling unit is capable of controlling operation of each of the above-mentioned units. Examples of the controlling unit include devices, such as a sequencer and a computer.

Figure 4:
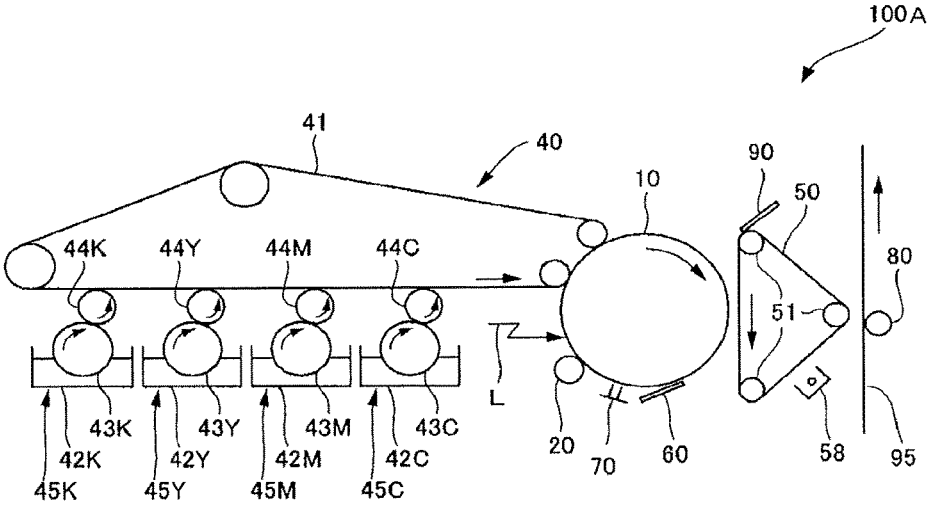
FIG. 4 is a schematic view illustrating one example of an image forming apparatus according to the present disclosure.

A first example of the image forming apparatus of the present disclosure is illustrated in FIG. 4. The image forming apparatus 100A includes a photoconductor drum 10, a charging roller 20, an exposing device, a developing device 40, an intermediate transfer belt 50, a cleaning device 60 including a cleaning blade, and a charge-eliminating lamp 70.

The intermediate transfer belt 50 is an endless belt supported by 3 rollers 51 disposed inside the intermediate transfer belt 50 and can move in the direction indicated with the arrow in FIG. 4. Part of the 3 rollers 51 also functions as a transfer bias roller capable of applying transfer bias (primary transfer bias) to the intermediate transfer belt 50. Moreover, the cleaning device 90 including the cleaning blade is disposed adjacent to the intermediate transfer belt 50. Furthermore, the transfer roller 80 capable of applying transfer bias (secondary bias) to the transfer paper 95 to transfer the toner image is disposed to face the intermediate transfer belt 50.

At the periphery of the intermediate transfer belt 50, moreover, the corona charger 58 configured to apply charge to the toner image transferred to the intermediate transfer belt 50 is disposed between a contact area between the photoconductor drum 10 and the intermediate transfer belt 50 and a contact area between the intermediate transfer belt 50 and the transfer paper 95 along the rotational direction of the intermediate transfer belt 50.

The developing device 40 is composed of a developing belt 41, and a black developing unit 45K, a yellow developing unit 45Y, a magenta developing unit 45M, and a cyan developing unit 45C disposed together at the periphery of the developing belt 41. Note that, the developing unit 45 of each color includes a developer stored unit 42, a developer supply roller 43, and a developing roller (developer bearer) 44. Moreover, the developing belt 41 is an endless belt supported by a plurality of belt rollers, and can move in the direction indicated with the arrow in FIG. 4. Furthermore, part of the developing belt 41 is in contact with the photoconductor drum 10.

Next, a method for forming an image using the image forming apparatus 100A will be described. First, a surface of the photoconductor drum 10 is uniformly charged by the charging roller 20. Then, the photoconductor drum 10 is exposed to exposure light L by means of an exposing device (not illustrated) to form an electrostatic latent image. Next, the electrostatic latent image formed on the photoconductor drum 10 is developed with a toner supplied from the developing device 40, to thereby form a toner image. Moreover, the toner image formed on the photoconductor drum 10 is transferred (primary transferred) onto the intermediate transfer belt 50 by the transfer bias applied from the roller 51. Then, the toner image is transferred (secondary transferred) onto transfer paper 95 by the transfer bias applied from the transfer roller 80. Meanwhile, the toner remained on the surface of the photoconductor drum 10, from which the toner image has been transferred to the intermediate transfer belt 50, is removed by the cleaning device 60. Then, the charge of the photoconductor drum 10 is eliminated by the charge-eliminating lamp 70.

Figure 5:
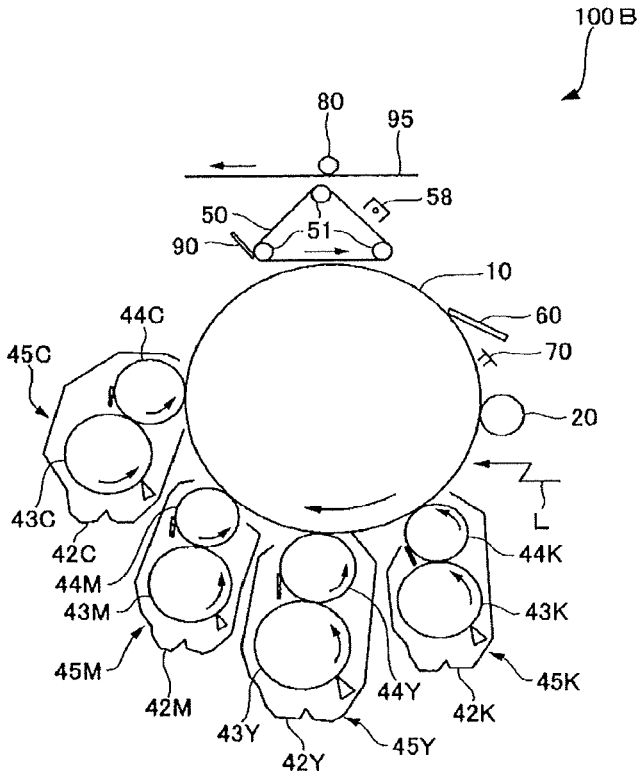
FIG. 5 is a schematic view illustrating another example of the image forming apparatus according to the present disclosure.

A second example of the image forming apparatus for use in the present disclosure is illustrated in FIG. 5. The image forming apparatus 100B has the identical structure to the structure of the image forming apparatus 100A, except that a black developing unit 45K, a yellow developing unit 45Y, a magenta developing unit 45M, and a cyan developing unit 45C are disposed at the periphery of the photoconductor drum 10 to directly face the photoconductor drum 10 without disposing the developing belt 41.

Figure 6:
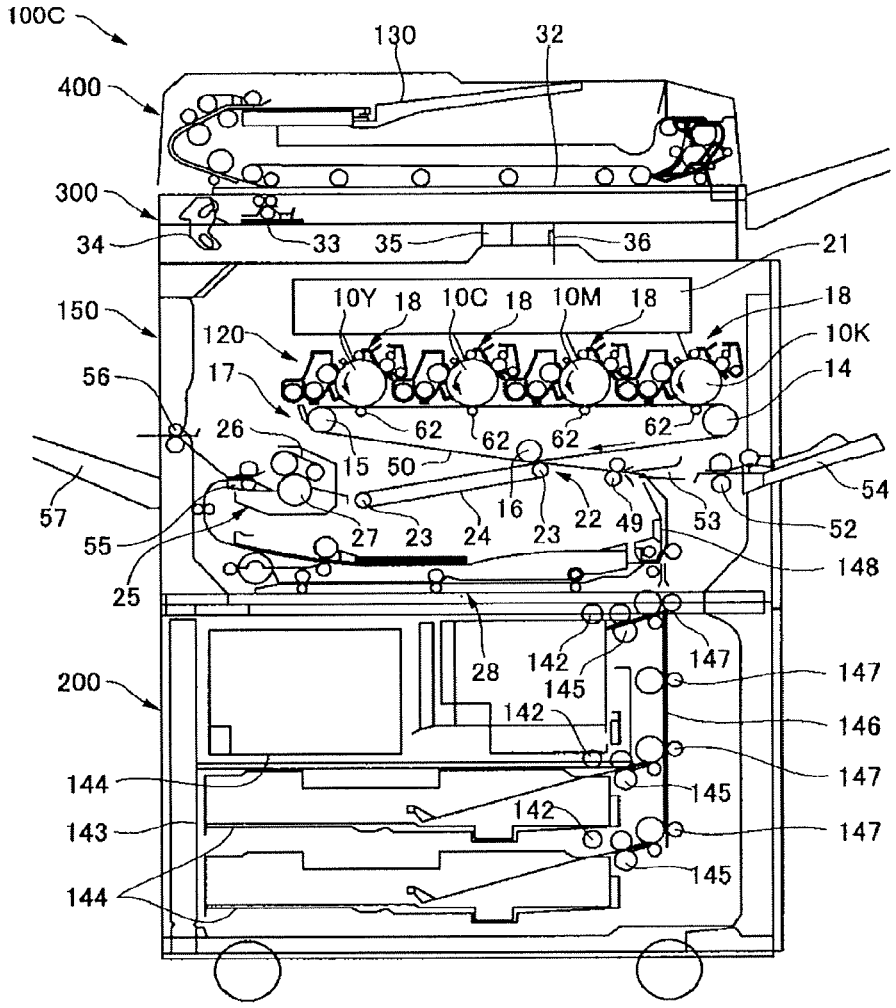
FIG. 6 is a schematic view illustrating another example of the image forming apparatus according to the present disclosure.

A third example of an image forming apparatus for use in the present disclosure is illustrated in FIG. 6. The image forming apparatus 100C is a tandem color image forming apparatus and includes a copier main body 150, a paper feeding table 200, a scanner 300, and an automatic document feeder (ADF) 400.

An intermediate transfer belt 50 disposed at a center of the copier main body 150 is an endless belt supported by three rollers 14, 15, and 16, and can move in the direction indicated with the arrow in FIG. 6. Near the roller 15, disposed is a cleaning device 17 having a cleaning blade configured to remove the toner remained on the intermediate transfer belt 50 from which the toner image has been transferred to recording paper. Yellow, cyan, magenta, and black image forming units 120Y, 120C, 120M, and 120K are aligned and disposed along the conveying direction to face a section of the intermediate transfer belt 50 supported by the rollers 14 and 15.

Moreover, an exposing device 21 is disposed near the image forming unit 120. Moreover, a secondary transfer belt 24 is disposed at the side of the intermediate transfer belt 50 opposite to the side thereof where the image forming unit 120 is disposed. Note that, the secondary transfer belt 24 is an endless belt supported by a pair of rollers 23. Recording paper transported on the secondary transfer belt 24 and the intermediate transfer belt 50 can be in contact with each other at the section between the roller 16 and the roller 23.

Moreover, a fixing device 25 is disposed near the secondary transfer belt 24, where the fixing device 25 includes a fixing belt 26 that is an endless belt supported by a pair of rollers, and a pressure roller 27 disposed to press against the fixing belt 26. Note that, a sheet reverser 28 configured to reverse recording paper when images are formed on both sides of the recording paper is disposed near the secondary transfer belt 24 and the fixing device 25.

Next, a method for forming a full-color image using the image forming apparatus 100C will be explained. First, a color document is set on a document table 130 of the automatic document feeder (ADF) 400. Alternatively, the automatic document feeder 400 is opened, a color document is set on contact glass 32 of the scanner 300, and then automatic document feeder 400 is closed. In the case where the document is set on the automatic document feeder 400, once a start switch is pressed, the document is transported onto the contact glass 32, and then the scanner 300 is driven to scan the document with a first carriage 33 equipped with a light source and a second carriage 34 equipped with a mirror. In the case where the document is set on the contact glass 32, the scanner 300 is immediately driven to scan the document with the first carriage 33 and the second carriage 34. During the scanning operation, light emitted from the first carriage 33 is reflected by the surface of the document, the reflected light from the surface of the document is reflected by the second carriage 34, and then the reflected light is received by a reading sensor 36 via an image formation lens 35 to read the document, to thereby image information of black, yellow, magenta, and cyan.

Figure 7:
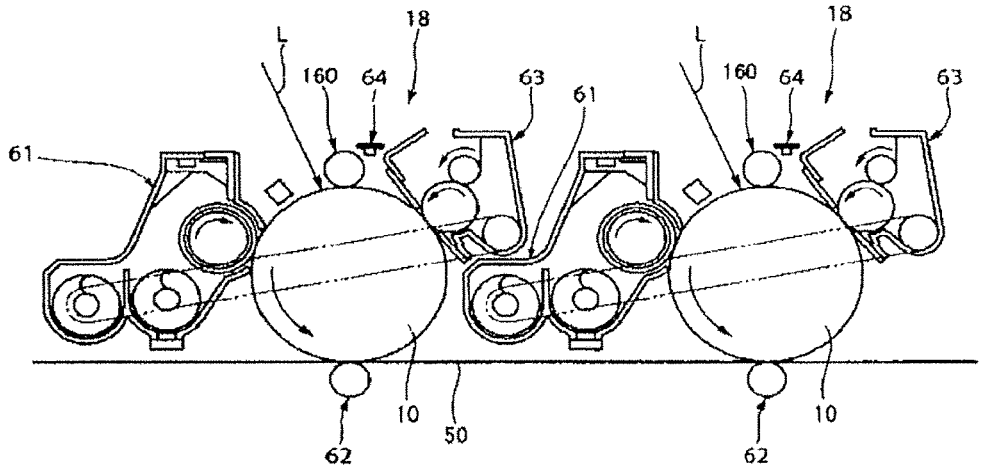
FIG. 7 is a schematic view illustrating another example of the image forming apparatus according to the present disclosure.

The image information of each color is transmitted to each image forming device 18 of each image-forming unit 120 of each color to form a toner image of each color. As illustrated in FIG. 7, the image-forming unit 120 of each color includes a photoconductor drum 10, a charging roller 160 configured to uniformly charge the photoconductor drum 10, an exposing device configured to expose the photoconductor drum 10 to exposure light L based on the image information of each color to form an electrostatic latent image for each color, a developing device 61 configured to develop the electrostatic latent image with a developer of each color to form a toner image of each color, a transfer roller 62 configured to transfer the toner image onto an intermediate transfer belt 50, a cleaning device 63 including a cleaning blade, and a charge-eliminating lamp 64.

The toner images of all of the colors formed by the image forming units 120 of all of the colors are sequentially transferred (primary transferred) onto the intermediate transfer belt 50 rotatably supported by the rollers 14, 15, and 16 to superimpose the toner images to thereby form a composite toner image.

In the paper feeding table 200, meanwhile, one of the paper feeding rollers 142 is selectively rotated to eject recording paper from one of multiple paper feeding cassettes 144 of the paper bank 143, pieces of the ejected recording paper are separated one by one by a separation roller 145 to send each recording paper to a paper feeding path 146, and then transported by a conveying roller 147 into a paper feeding path 148 within the copier main body 150. The recording paper transported in the paper feeding path 148 is then bumped against a registration roller 49 to stop. Alternatively, pieces of the recording paper on a manual-feeding tray 54 are ejected by rotating a paper feeding roller, separated one by one by a separation roller 52 to guide into a manual paper feeding path 53, and then bumped against the registration roller 49 to stop.

Note that, the registration roller 49 is generally earthed at the time of use, but it may be biased for removing paper dusts of the recording paper. Next, the registration roller 49 is rotated synchronously with the movement of the composite toner image on the intermediate transfer belt 50, to thereby send the recording paper between the intermediate transfer belt 50 and the secondary transfer belt 24. The composite toner image is then transferred (secondary transferred) to the recording paper. Note that, the toner remained on the intermediate transfer belt 50, from which the composite toner image has been transferred, is removed by the cleaning device 17.

The recording paper to which the composite toner image has been transferred is transported on the secondary transfer belt 24 and then the composite toner image is fixed thereon by the fixing device 25. Next, the traveling path of the recording paper is switched by a separation craw 55 and the recording paper is ejected to a paper ejection tray 57 by an ejecting roller 56. Alternatively, the traveling path of the recording paper is switched by the separation craw 55, the recording paper is reversed by the sheet reverser 28, an image is formed on a back side of the recording paper in the same manner, and then the recording paper is ejected to the paper ejection tray 57 by the ejecting roller 56.

EXAMPLES

Examples of the present disclosure will be described hereinafter, but Examples shall not be construed as limiting the present disclosure. "Part(s)" denotes "part(s) by mass" and "%" denotes "% by mass" unless otherwise stated.

Example 1

<Production of Toner 1>

—Preparation of Colorant Dispersion Liquid—

First, a carbon black dispersion liquid was prepared as a colorant.

In 78 parts of ethyl acetate, 20 parts of carbon black (Regal400, available from Cabot Corporation) and 2 parts of a pigment disperser (AJISPER PB821, available from Ajinomoto Fine-Techno Co., Ltd.) were primary dispersed using a mixer having a stirring blade. The obtained primary dispersion liquid was finely dispersed by strong shearing force using DYNO-MILL to prepare a secondary dispersion liquid from which aggregates had been completely removed. Moreover, the secondary dispersion liquid was passed through a polytetrafluoroethylene (PTFE) filter having pores of 0.45 μm (fluorinate membrane filter FHLP09050, available from Japan Millipore) to disperse until a sub-micron region to thereby prepare a carbon black dispersion liquid.

—Preparation of Toner Composition Liquid—

In 660.7 parts of ethyl acetate, 20 parts of [WAX 1] as a release agent, 18 parts of [Inorganic Particles A] (organosilica sol MEK-ST-UP, solid content (ER): 20%, average primary particle diameter: 15 nm, available from NISSAN CHEMICAL INDUSTRIES, LTD.) as inorganic particle dispersion liquid, 2 parts of a release agent disperser, and 250.3 parts of [Polyester Resin A] as a binder resin were mixed at 70° C. and were dissolved by means of a mixer having a stirring blade. As the release agent disperser, a polyethylene release agent to which a styrene-butyl acrylate had been grafted was used. [WAX 1] and [Polyester Resin A] were both dissolved in ethyl acetate transparently without causing phase separation. After the dissolution, the liquid temperature was adjusted to 55° C., and 100 parts of the carbon black dispersion liquid was further mixed with the resultant, and the resultant mixture was stirred for 10 minutes to thereby prepare a toner composition liquid.

Note that, [WAX 1] was ester wax having a melting point of 70.5° C. (Sanyo chemical Industries, Ltd.).

Moreover, [Polyester Resin A] was a binder resin having a weight average molecular weight of 25,500 and Tg of 62° C. where the binder resin was composed of terephthalic acid, isophthalic acid, succinic acid, ethylene glycol, and neopentyl glycol.

As the weight average molecular weight Mw of the binder resin, the THF soluble component of the binder resin was measured by means of a gel permeation chromatography (GPC) measuring device GPC-150C (available from Waters). As columns, KF801 to 807 (available from Shodex) were used. As a detector, a refractive index (RI) detector was used. A boiling point of ethyl acetate was 76.8° C.

—Production of Toner—

The obtained toner composition liquid was ejected as droplets by means of a toner production device illustrated in FIG. 3 having a droplet ejection head illustrated in FIG. 2 as a droplet-ejecting unit. After ejecting droplets, the droplets were dried and solidified by a droplet-solidifying unit using dry nitrogen and the resultant particles were collected by a cyclon to produce a toner base particle intermediate product. As additional drying, the obtained base particle intermediate product was air dried for 48 hours at 35° C. and 90% RH, and for 24 hours at 40° C. and 50% RH.

Production of the toner was continuously performed for 6 hours, but clogging of ejection holes did not occur.

[Toner Production Conditions]

The length L of the liquid-column-resonance liquid chamber in the longitudinal direction: 1.85 mm Ejection pore opening: 8.0 μm in diameter Temperature of droplet ejection unit: 40° C.

Drying temperature (nitrogen): 60° C.

Ethyl acetate relative humidity (in nitrogen flow): 8%

Driving frequency: 340 kHz

Voltage applied to piezoelectric body: 10.0 V

Next, into 100 parts of the toner base particles, 2.8 parts of NAX50 [average primary particle diameter: 30 nm, available from NIPPON AEROSIL CO., LTD.] and 0.9 parts of H20TM [average primary particle diameter: 20 nm, available from Clariant], both of which were commercially available silica powder, were mixed by means of HENSCHEL MIXER. Subsequently, the resultant was passed through a sieve having opening of 60 μm to remove coarse particles or aggregates, to thereby obtain [Toner 1].

Example 2

<Production of Toner 2>

[Toner 2] was obtained in the same manner as in Example 1, except that the drying temperature was changed to 68° C. in the toner production conditions of Example 1.

Example 3

<Production of Toner 3>

[Toner 3] was obtained in the same manner as in Example 1, except that the drying temperature was changed to 52° C. in the toner production conditions of Example 1.

Example 4

<Production of Toner 4>

[Toner 4] was obtained in the same manner as in Example 1, except that the drying temperature was changed to 73° C. in the toner production conditions of Example 1.

Example 5

<Production of Toner 5>

[Toner 5] was obtained in the same manner as in Example 1, except that the amount of the release agent [WAX 1] added was changed to 38 parts in the preparation of the toner composition liquid.

Example 6

<Production of Toner 6>

[Toner 6] was obtained in the same manner as in Example 1, except that the amount of the release agent [WAX 1] added was changed to 7 parts in the preparation of the toner composition liquid.

Example 7

<Production of Toner 7>

[Toner 7] was obtained in the same manner as in Example 1, except that [Inorganic Particles A] were changed to [Inorganic Particles B] (organosilica sol MEK-ST-L, solid content (ER): 20%, average primary particle diameter: 40 nm, available from NISSAN CHEMICAL INDUSTRIES, LTD.) in the preparation of the toner composition.

Comparative Example 1

<Production of Toner 8>

—Preparation of Resin Emulsion—

The following monomers were homogeneously mixed to produce a monomer mixture liquid.

Styrene monomer: 71 parts n-Butyl acrylate: 25 parts

Acrylic acid: 4 parts

A reactor was charged with the following aqueous liquid mixture and the aqueous liquid mixture was heated to 70° C. with stirring. In the state the aqueous liquid mixture was stirred with maintaining a temperature of the liquid at 70° C., the monomer mixture liquid above and 5 parts of a 1% potassium persulfate were simultaneously dripped for 4 hours and the resultant mixture was allowed to go through polymerization for 2 hours at 70° C., to thereby yield a resin emulsion having a solid content of 50%.

Water: 100 parts

Nonionic emulsifier (EMULGEN 950): 1 part

Anionic emulsifier (NEOGEN R): 1.5 parts

—Adjustment of Toner Particles—

The following mixture was stirred for 2 hours by means of a disperser with mtaintaining a temperature of 25° C.

Pigment: 20 parts

Charge controlling agent (E-84, available from ORIENT CHEMICAL INDUSTRIES CO., LTD.): 1 part Anionic emulsifier (NEOGEN R): 0.5 parts Water: 310 parts Subsequently, 188 parts of the emulsion above was added to the dispersion liquid and the resultant was stirred for about 2 hours, followed by heating to 60° C. The resultant was adjusted to pH 7.0 with ammonia. Moreover, the resultant dispersion liquid was heated to 90° C. and the temperature thereof was maintained at 90° C. for 2 hours, to thereby obtain Dispersion Slurry 1.

After performing filtration of 100 parts of [Dispersion Slurry 1] under the reduced pressure, (1): 100 parts of ion-exchanged water was added to the filtration cake and the resultant was mixed by TK Homomixer (for 10 minutes at the rotational speed of 12,000 rpm), followed by filtration.

(2): To the filtration cake of (1), 10% hydrochloric acid was added to adjust pH to pH 2.8, and the resultant was mixed by TK Homomixer (for 10 minutes at the rotational speed of 12,000 rpm), followed by filtration.

(3): To the filtration cake of (2), 300 parts of ion-exchanged water was added, and the resultant was mixed by TK Homomixer (for 10 minutes at the rotational speed of 12,000 rpm), followed by filtration. This operation was performed twice to obtain [Filtration Cake 1].

[Filtration Cake 1] was dried for 48 hours at 45° C. by a circulating air drier and the resultant was sieved with a mesh having an opening size of 75 μm, to thereby obtain toner base particles having a weight average particle diameter of 5.9 μm.

—Mixing with External Additives—

Next, 100 parts of the toner base particles were mixed with 2.8 parts of NAX50 [average primary particle diameter: 30 nm, available from NIPPON AEROSIL CO., LTD.] and 0.9 parts of H20TM [average primary particle diameter: 20 nm, available from Clariant], both of which were commercially available silica powder, by means of HENSCHEL MIXER. Subsequently, the resultant was passed through a sieve having an opening size of 60 μm to remove coarse particles or aggregates, to thereby obtain [Toner 9].

Comparative Example 2

<Production of Toner 9>

—Synthesis of Organic Particle Emulsion—

A reaction vessel equipped with a stirring rod and a thermometer was charged with 703 parts of water, 11 parts of sodium salt of ethyl methacrylate oxide adduct sulfuric acid ester (ELEMINOL RS-30, available from Sanyo Chemical Industries, Ltd.), 82 parts of styrene, 88 parts of methacrylic acid, 120 parts of butyl acrylate, 14 parts of butyl thioglycolate, and 1 part of ammonium persulfate, and the resultant mixture was stirred for 15 minutes at 400 rpm, to thereby obtain white emulsion. The white emulsion was heated and the temperature inside the system was elevated to 75° C. to allow the emulsion to react for 5 hours. Subsequently, 30 parts of a 1% ammonium persulfate aqueous solution was added to the resultant and the resultant mixture was matured for 5 hours at 75° C., to thereby synthesize an aqueous dispersion liquid of a vinyl-based resin (styrene-methacrylic acid-butyl acrylate-sodium salt of ethyl methacrylate oxide adduct sulfuric acid ester copolymer). The resultant was provided as [Particle Dispersion Liquid 1].

A volume average particle diameter of [Particle Dispersion Liquid 1] obtained as measured by a laser diffraction particle size distribution measuring device (LA-920, available from Shimadzu Corporation) was 120 nm.

Moreover, part of [Particle Dispersion Liquid 1] was dried to separate a resin component. A glass transition temperature (Tg) of the resin component was 74° C. and a weight average molecular weight (Mw) of the resin component was 35,000.

—Preparation of Aqueous Phase—

Water (990 parts), 83 parts of [Particle Dispersion Liquid 1], 37 parts of 48.5% sodium dodecyldiphenyl ether disulfonate aqueous solution (ELEMINOL MON-7, available from Sanyo Chemical Industries, Ltd.) and 90 parts of ethyl acetate were mixed and stirred to prepare a milky white liquid. The milky white liquid was provided as [Aqueous Phase 1].

—Synthesis of Low Molecule Polyester—

A reaction vessel equipped with a cooling tube, a stirrer, and a nitrogen-inlet tube was charged with 229 parts of bisphenol A ethylene oxide (2 mol) adduct, 529 parts of bisphenol A propylene oxide (3 mol) adduct, 208 parts of terephthalic acid, 46 parts of adipic acid, and 2 parts of dibutyl tin oxide, and the resultant mixture was allowed to react for 8 hours at 230° C. under ordinary pressure. Subsequently, the resultant was allowed to react for 5 hours under the reduced pressure of from 10 mmHg through 15 mmHg. Then, 44 parts of trimellitic acid anhydride was added to the reaction vessel, and the resultant was allowed to react for 2 hours at 180° C. under ordinary pressure, to thereby synthesize polyester. The synthesized polyester was provided as [Low Molecule Polyester 1].

[Low Molecule Polyester 1] obtained had a number average molecular weight (Mn) of 2,800, a weight average molecular weight (Mw) of 7,500, a glass transition temperature (Tg) of 44° C., and an acid value of 25 mgKOH/g.

—Synthesis of Intermediate Polyester—

A reaction vessel equipped with a cooling tube, a stirrer, and a nitrogen-inlet tube was charged with 682 parts of bisphenol A ethylene oxide (2 mol) adduct, 81 parts of bisphenol A propylene oxide (2 mol) adduct, 283 parts of terephthalic acid, 22 parts of trimellitic acid anhydride, and 2 parts of dibutyl tin oxide, and the resultant mixture was allowed to react for 8 hours at 230° C. at ordinary pressure. Subsequently, the resultant was allowed to react for 5 hours under the reduced pressure of from 10 mmHg through 15 mmHg to synthesize polyester. The synthesized polyester was provided as [Intermediate Polyester 1].

[Intermediate Polyester 1] obtained had a number average molecular weight of (Mn) of 2,100, a weight average molecular weight (Mw) of 9,500, a glass transition temperature (Tg) of 55° C., an acid value of 0.5 mgKOH/g, and a hydroxy value of 51 mgKOH/g.

Next, a reaction vessel equipped with a cooling tube, a stirrer, and a nitrogen-inlet tube was charged with 410 parts of [Intermediate Polyester 1], 89 parts of isophorone diisocyanate, and 500 parts of ethyl acetate and the resultant mixture was allowed to react for 5 hours at 100° C. to thereby obtain an addition reaction product. The addition reaction product was provided as [Prepolymer 1].

Mass percentage (%) of free isocyanate of [Prepolymer 1] was 1.53%.

—Synthesis of Ketimine—

A reaction vessel with which a stirring rod and a thermometer were set was charged with 170 parts of isophorone diamine and 150 parts of methyl ethyl ketone, and the resultant mixture was allowed to react for 5 hours at 50° C. to thereby synthesize a ketimine compound. The ketimine compound was provided as [Ketimine Compound 1].

An amine value of [Ketimine Compound 1] obtained was 418.

—Synthesis of Master Batch—

Water (1,200 parts), 540 parts of carbon black (Printex35, available from Degussa) (DBP oil absorption: 42 mL/100 mg, pH: 9.5), and 1,200 parts of a polyester resin (RS801, available from Sanyo chemical Industries, Ltd.), and the resultant mixture was mixed by means of HENSCHEL MIXER (available from Mitsui Mining and Smelting Co., Ltd). The obtained mixture was kneaded for 30 minutes at 150° C. by means of two rolls, then the resultant was rolled and cooled, followed by pulverization by means of a pulverizer, to thereby obtain a master batch. The master batch was provided as [Bk Master Batch 1].

—Preparation of Oil Phase—

A vessel with which a stirring rod and a thermometer were set was charged with 480 parts of [Low Molecule Polyester 1], 26 parts of carnauba wax, and 850 parts of ethyl acetate, and the resultant mixture was heated to 80° C. with stirring. The temperature of the mixture was maintained at 80° C. for 5 hours. The mixture was then cooled to 30° C. for 1 hour. The wax therein was dispersed by means of a bead mill (ULTRA VISCOMILL, available from AIMEX CO., LTD.) under the conditions that the liquid feeding rate was 1 kg/hr, the disk circumferential velocity was 6 m/sec, 0.5 mm-zirconia beads were packed in the amount of 80% by volume, and the number of passes was 3. Subsequently, the vessel was charged with 110 parts of [Bk Master Batch 1] and 500 parts of ethyl acetate, the resultant mixture was mixed for 1 hour to thereby obtain a solution. The solution was provided as [Bk Raw Material Solution].

Into a vessel, 900 parts of [Bk Raw Material Solution] was transferred. To the vessel, 50 parts of ethyl acetate and 165 parts of methyl ethyl ketone (MEK) were added. The resultant was dispersed by means of the above-mentioned bead mill under the conditions that the liquid feeding rate was 1 kg/hr, the disk circumferential velocity was 8 m/sec, 0.5 mm-zirconia beads were packed in the amount of 80% by volume, and the number of passes was 3, to thereby obtain a dispersion liquid. The dispersion liquid was provided as [Bk Pigment/Wax Dispersion Liquid].

To 100 parts of [Bk Pigment/Wax Dispersion Liquid] above, 25 parts of inorganic particles (organosilica sol MEK-ST-UP, solid content (ER): 20%, average primary particle diameter: 15 nm, available from NISSAN CHEMICAL INDUSTRIES, LTD.) were added, and the resultant mixture was mixed by TK Homomixer. The resultant mixture was provided as [Bk Oil Phase].

The rotational speed of the mixer was 6,500 rpm and the duration of the mixing was 10 minutes.

—Emulsification, Removal of Solvent, and Deformation of Toner Particles—

[Bk Oil Phase] (120 parts), 20 parts of [Prepolymer 1], and 1.2 parts of [Ketimine Compound 1] were mixed to thereby obtain [Preparation Liquid 1 of Resin and Colorant] having a solid content of 50%. After adding 150 parts of [Preparation Liquid 1 of Resin and Colorant] to 200 parts of [Aqueous Phase 1], the resultant mixture was mixed by means of TK Homomixer (available from PRIMIX Corporation) for 1 minute at the rotational speed of 12,000 rpm at 25° C. to thereby obtain Emulsified Dispersion Liquid (1). Note that, [Bk Oil Phase] is preferably used for emulsification within 12 hours from the production thereof.

Into a stainless steel flask equipped with a helical ribbon triple stirring blade, 100 parts of Emulsified Dispersion Liquid (1) was transferred. The ethyl acetate was removed from the emulsified liquid for 6 hours at 25° C. under the reduced pressure of (10 kPa) with stirring at the rotational speed of 60 rpm, until the concentration of the ethyl acetate in the emulsified liquid was to be 5%, to thereby obtain Emulsified Dispersion Liquid (Y-1).

To Emulsified Dispersion Liquid (Y-1), 3.1 parts of carboxy methyl cellulose (Cellogen HH, available from DKS Co., Ltd.) was added to thicken the emulsified dispersion liquid. Thereafter, ethyl acetate was removed from the resultant emulsified dispersion liquid under the reduced pressure (10 kPa) with stirring at the rotational speed of 300 rpm to apply shear force until a concentration of the ethyl acetate in the emulsified liquid was to be 3%.

Moreover, the removal of the solvent was proceeded with decreasing the rotational speed to 60 rpm until the concentration of the ethyl acetate was to be 1%, to thereby obtain [Dispersion Slurry 1].

The viscosity of the emulsified liquid after the thickening was 25,000 mPa·s.

—Washing and Drying—

After filtering 100 parts of [Dispersion Slurry 1] under the reduced pressure, washing and drying were performed in the following manner.

(1) To the filtration cake, 100 parts of ion-exchanged water was added. The resultant was mixed by TIC Homomixer (for 10 minutes at the rotational speed of 12,000 rpm), followed by filtration.

(2) To the filtration cake of (1), 100 parts of a 0.1% sodium hydroxide aqueous solution was added. The resultant was mixed by TK Homomixer (for 30 minutes at the rotational speed of 12,000 rpm), followed by filtration.

(3) To the filtration cake of (2), 100 parts of 0.1% hydrochloric acid was added. The resultant was mixed by TK Homomixer (for 10 minutes at the rotational speed of 12,000 rpm).

(4) To the filtration cake of (3), 300 parts of ion-exchanged water was added. The resultant was mixed by TK Homomixer (for 10 minutes at the rotational speed of 12,000 rpm) followed by filtration. This series of operations was performed twice.

(5) To the filtration cake of (4), 100 parts of ion-exchanged water was added. To the resultant, 20 parts of a 1% Ftergent F-300 (available from NEOS COMPANY LIMITED) aqueous solution as a fluorine-containing compound was slowly chipped with stirring at the rotational speed of 200 rpm. The resultant was stirred further for 30 minutes, followed by filtration under the reduced pressure.

(6) The operations of (1) were performed twice, to thereby obtain [Filtration Cake 1].

Next, [Filtration Cake 1] obtained was dried by a circulating air drier for 48 hours at 45° C. Thereafter, the resultant was sieved through a mesh having openings of 75 μm to produce toner base particles.

—Mixing with External Additives—

Next, to 100 parts of the toner base particles, 2.8 parts of NAX50 [average primary particle diameter: 30 nm, available from NIPPON AEROSIL CO., LTD.] and 0.9 parts of H20TM [average primary particle diameter: 20 nm, available from Clariant], which were commercially available silica powder, were mixed by means of HENSCHEL MIXER. Subsequently, the resultant was passed through a sieve having openings of 60 μm to remove coarse particles or aggregates, to thereby obtain [Toner 9].

Comparative Example 3

<Production of Toner 10>

[Toner 10] was obtained in the same manner as in Example 1, except that the drying temperature was changed to 78° C. in the toner production conditions.

Comparative Example 4

<Production of Toner 11>

[Toner 11] was obtained in the same manner as in Example 1, except that the drying temperature was changed to 49° C. in the toner production conditions.

Comparative Example 5

<Production of Toner 12>

[Toner 12] was obtained in the same manner as in Example 1, except that [Inorganic Particles A] was changed to [Inorganic Particles B] (organosilica sol MEK-ST-L, solid content (ER): 20%, average primary particle diameter: 40 nm, available from NISSAN CHEMICAL INDUSTRIES, LTD.) in the preparation of the toner composition liquid and the drying temperature was changed to 49° C. in the toner production conditions.

(Physical Properties)

The following physical properties of the obtained toners were measured. The results are presented in Tables 2-1 and 2-2.

<$X_{surf}$>

The toner base particles were dispersed in a 67% by mass sucrose saturated aqueous solution and the resultant was frozen at −100° C. Thereafter, the resultant was sliced into a slice having a thickness of about 1,000 Angstrom by Cryomicrotome (EM-FCS, available from Laica). A photograph of a cross-section of particles was taken by a transmission electron microscope (JEM-2010, available from JEOL Ltd.) with magnification of 10,000 times, and an area ratio of a silica shadow in a region that was a part from a surface of a toner base particle to 200 nm in thickness towards inside the particle in a vertical direction on a cross-section with which the cross-sectional area was the maximum was determined by an image analyzer (nexus NEW CUBE ver. 2.5, available from NEXUS). For the measurement, randomly selected 10 toner particles were measured and an average value of the measured values was determined as a measurement value.

<S(180)/S(30)>

A toner was placed on gloss paper POD gloss-coated paper 128 (available from Oji Paper Co., Ltd.) in a manner that particles were each present as a single particle as much as possible using air flow.

Next, the gloss paper, on which the toner had been placed, was cut out into a piece having sides of 1 cm, and then the cut piece was set in a heating device for a microscope (available from JAPAN HIGH TECH CO., LTD.) and was heated at a temperature from 30° C. through 180° C. at 10° C./min.

The state of the cut piece during heating was observed under a microscope and the state of the toner being melted and spread was taken into a PC as a video. In this case, the observation magnification was the magnification at which a region of 400 μm×400 μm could be observed. The image of the particles of the toner at 30° C. and the image of the particles of the toner at 180° C. were analyzed by image processing software to calculate an area of each of 100 particles. Then, S(180)/S(30), which was a ratio of an area of a particle at 180° C. (S(180)) to an area of a particle at 30° C. (S(30)), is determined.

<Silicon Atom Concentration>

For the measurement of the silicon atom concentration, 1600S-type X-ray photoelectron spectrometer available from PHI was used, an X-ray source was MgKα (400 W), and an analysis region was 0.8 mm×2.0 mm.

Note that, as a pretreatment, an aluminium dish was packed with a sample, and was adhered to a sample holder with a carbon sheet.

For calculation of the surface atom concentration, a relative sensitivity factor provided by PHI was used.

<n-Hexane Extraction>

An amount of the wax, which was the release agent, extracted using n-hexane was measured by the following method.

The measurement of the wax extraction amount was performed according to the following manner using the predetermined amounts presented in Table 1 as standards.

1) Hexane was weighed and collected in a centrifuge tube by an amount (Predetermined value 2) by means of Dispensette.

2) A toner was weighed and collected on paper for wrapping powder medicine by an amount (Predetermined value 1) by means of a scale.

3) The toner was added into the centrifuge tube using a test tube stand and the centrifuge tube is sealed with a cap.

4) Stirring was performed with setting the scale of Vortex mixer to Predetermined value 3 and setting the stirring duration to Predetermined value 4.

5) The centrifuge tube was set in a centrifuge, and the rotational speed and retention time were set to Predetermined value 5 to precipitate the toner.

6) An aluminium cup with a handle was weighed and the measured value (X) is recorded.

7) The supernatant liquid was added to the aluminium cup with the handle by Predetermined value 6 and then was placed in a vacuum drier of 150° C.

8) A scale of pressure of the vacuum dried was set to Predetermined value 7. Wait for 5 minutes until hexane was evaporated.

9) The aluminium cup with the handle was taken out from the vacuum dried and then was placed in a desiccator to cool for the duration of Predetermined value 8.

10) The aluminium cup with the handle was weighed and the measured value (Y) was recorded.

11) Wax extraction amount (mg)=(weight of aluminium cup (Y)−weight of aluminium cup (X))×1,000×4.6/3 (Formula 6)

The extracted amount of the wax was determined by (Formula 6) above.

<<Average Primary Particle Diameter of Silica>>

An average primary particle diameter of the silica, which was detected from a transmission electron microscopic (TEM) photograph of a cracked surface of the toner base particle, was determined based on the transmission electron microscopic (TEM) photograph of the cracked surface of the toner base particle.

A specific measuring method was described as follows.

A toner was embedded in an epoxy resin, and the epoxy resin was sliced by an ultramicrotome (ultrasonic) to produce a thin slice. A cracked surface of the toner base particle on the thin slice was observed under a transmission electron microscope (TEM) by enlarging a field of view of the microscope until a particle diameter of silica present on the toner base particle could be measured from the cracked surface of the toner with adjusting a magnification of the microscope, to extract arbitrarily selected 3 cracked surfaces of the toner as samples for measurement. At the time of the observation, silica in the toner may be enhanced by dying using ruthenium or osmium to enhance the contrast, if necessary. After measuring particle diameters of 10 silica particles per toner particle, an average value of 30 particles in total was determined.

<Average Circularity>

An average circularity was measured by means of a flow particle image analyzer FPIA-3000 available from SYSMEX CORPORATION under the following analysis conditions.

[Analysis Conditions]

Condition 1, limits of particle diameters: 1.985 μm≤equivalent circle diameter (number base)<200.0 μm Condition 2, limits of particle shapes: 0.200≤circularity≤1.000

Condition 3, limits of the number of particles (the number of particles satisfying Conditions 1 and 2): 4,800 particles or greater but 5,200 particles or less Note that, the outline of FPIA-3000 was described earlier.

<Measurements of Particle Diameter and Particle Size Distribution of Toner>

A volume average particle diameter (Dv) and number average particle diameter (Dn) of the toner were measured by means of a particle size measuring device ("Multisizer III," available from Beckman Coulter, Inc.) with an aperture diameter of 50 μm. After measuring the volume and the number of toner particles, a volume distribution and a number distribution were calculated. The volume average particle diameter (Dv) and number average particle diameter (Dn) of the toner could be determined from the obtained distributions. As the particle size distribution, used was Dv/Dn that is a value obtained by dividing the volume average particle diameter (Dv) of the toner with the number average particle diameter (Dn) of the toner. When the toner particles were completely monodisperse particles, the value of the particle size distribution was 1. The larger value of the particle size distribution meant the wider particle size distribution.

Moreover, a modal diameter and a second peak were determined from the particle size distribution.

<Glass Transition Temperature (Tg)>

A glass transition temperature of the toner was measured by means of a DSC system (differential scanning calorimeter) ("Q-200," available from TA Instruments).

First, a sample container formed of aluminium was charged with about 5.0 mg of a target sample, the sample container was placed on a holder unit, and the holder unit was set in an electric furnace. Subsequently, the sample was heated in a nitrogen atmosphere from −80° C. to 150° C. at a heating rate of 10° C./min (first heating). Thereafter, the sample was cooled from 150° C. to −80° C. at a cooling rate of 10° C./min. Then, the sample was heated to 150° C. at a heating rate of 10° C./min (second heating). A DSC curve was measured for each of the first heating and the second heating by means of a differential scanning calorimeter ("Q-200," available from TA Instruments).

A DSC curve for the first heating was selected from the obtained DSC curves using an analysis program installed in the Q-200 system to determine a glass transition temperature of the target sample for the first heating.

TABLE 2-1

| | | Toner | Xsurf abundance ratio (%) | S(180)/S(30) (—) | XPS surface Si content atomic % | n-Hexane release agent extraction amount (mg) | Average primary particle diameter of silica (nm) | Average circularity (—) |
|---|---|---|---|---|---|---|---|---|
| Ex. | 1 | 1 | 80 | 1.6 | 18 | 21 | 15 | 0.978 |
| | 2 | 2 | 74 | 1.7 | 13 | 24 | 15 | 0.974 |
| | 3 | 3 | 85 | 1.4 | 31 | 11 | 15 | 0.981 |
| | 4 | 4 | 70 | 1.7 | 8 | 24 | 15 | 0.968 |
| | 5 | 5 | 76 | 1.5 | 18 | 4 | 15 | 0.978 |
| | 6 | 6 | 76 | 1.6 | 19 | 31 | 15 | 0.979 |
| | 7 | 7 | 82 | 1.4 | 28 | 15 | 40 | 0.982 |
| Comp. | 1 | 8 | 0 | 1.8 | 0 | 26 | — | 0.968 |
| Ex. | 2 | 9 | 77 | 1.3 | 14 | 17 | 15 | 0.967 |
| | 3 | 10 | 67 | 1.7 | 12 | 17 | 15 | 0.981 |
| | 4 | 11 | 92 | 1.4 | 29 | 15 | 15 | 0.970 |
| | 5 | 12 | 72 | 1.8 | 13 | 20 | 40 | 0.976 |

TABLE 2-2

| | | | Particle diameter | | Particle size distribution | | | |
|---|---|---|---|---|---|---|---|---|
| | | Toner | Dv (μm) | Dv/Dn (—) | Modal diameter A (μm) | Second peak B (μm) | B/A | Tg (° C.) |
| Ex. | 1 | 1 | 5.3 | 1.12 | 5.1 | 6.1 | 1.20 | 61 |
| | 2 | 2 | 5.1 | 1.13 | 5.1 | 6.2 | 1.22 | 63 |
| | 3 | 3 | 5.3 | 1.13 | 5.1 | 6.2 | 1.22 | 61 |
| | 4 | 4 | 5.1 | 1.13 | 4.9 | 5.9 | 1.20 | 62 |
| | 5 | 5 | 5.3 | 1.13 | 5.0 | 6.1 | 1.22 | 61 |
| | 6 | 6 | 5.1 | 1.12 | 5.1 | 6.2 | 1.22 | 63 |
| | 7 | 7 | 5.2 | 1.13 | 4.9 | 6.1 | 1.24 | 62 |
| Comp. | 1 | 8 | 5.9 | 1.13 | 5.9 | — | — | 68 |
| Ex. | 2 | 9 | 5.1 | 1.14 | 5.1 | — | — | 64 |
| | 3 | 10 | 5.3 | 1.13 | 5.1 | 6.1 | 1.20 | 61 |
| | 4 | 11 | 5.3 | 1.12 | 4.9 | 5.9 | 1.20 | 62 |
| | 5 | 12 | 5.2 | 1.13 | 5.1 | 6.1 | 1.20 | 61 |

(Production of Two-Component Developer)

—Production of Carrier—

Silicone resin (organo straight silicone): 100 parts

Toluene: 100 parts

γ-(2-aminoethyl)aminopropyltrimethoxysilane: 5 parts

Carbon black: 10 parts

The mixture above was dispersed by a homomixer for 20 minutes to prepare a coating layer-forming liquid. The coating layer-forming liquid was applied to coat surfaces of spherical magnetite particles (1,000 parts) having particle diameters of 50 μm with the coating layer-forming liquid by a fluidized bed coater to thereby obtain a magnetic carrier.

—Production of Two-Component Developer—

By means of a ball mill, 4 parts of each of Toners 1 to 12 obtained and 96.0 parts of the magnetic carrier above were mixed to thereby produce Two-Component Developers 1 to 12 of Examples 1 to 7 and Comparative Examples 1 to 5.

—Evaluation Results of Two-Component Developers—

Evaluations of cold offset, glossiness, and gloss unevenness were performed on Two-Component Developers 1 to 12 according to the following evaluation methods. The evaluation results are presented in Table 3. Moreover, evaluation methods of particle diameters and particle size distribution of the toner are also described below.

<<Cold Offset>>

An image in the shape of a rectangle of 3 cm×5 cm was formed on an A4-size sheet (T6000 70 W long grain, available from Ricoh Company Limited) at the position that was 5 cm from the edge of the surface of the sheet using the two-component developer by means of a commercially available copier, which was a copier imageo Neo C600 available from Ricoh Company Limited, to thereby produce a toner sample having a deposition amount of 0.85 mg/cm$^2$. Subsequently, the toner sample was fixed with always setting a temperature of a fixing roller to 130° C. at a linear speed of 300 mm/sec (a weight of the toner was calculated from the weights of the sheet before and after the image output). The presence of offset occurred at 130° C. was visually observed by the tester and judged based on the following criteria.

[Evaluation Criteria]

Good: Cold offset did not occur.

Fair: Cold offset occurred but occurred at less than 3 spots.

Poor: Cold offset occurred.

<<Glossiness>>

A solid image (image size: 3 cm×8 cm) was formed on an entire surface of paper, on which a deposition amount of a toner after transferred was 0.65±0.02 mg/cm$^2$, by means of a commercially available copier imageo Neo C600 (available from Ricoh Company Limited).

A temperature of a fixing roller was adjusted per 5° C. from the minimum fixing temperature to the maximum fixing temperature to measure 60° glossiness of the fixed image.

As a sheet used for the evaluation, coated glossy paper (135 g/m$^2$) available from Mondi was used. As the gloss, 60° gloss of the image was measured on 5 spots by means of a gloss meter VGS-1D available from NIPPON DENSHOKU INDUSTRIES CO., LTD., and an average of the values measured at 3 spots excluding the maximum value and the minimum values from the 5 measured values was determined as glossiness of the image. The measurement was performed under the measuring conditions according to JIS-Z8781 (1983 Method 3).

The determined criteria.

[Evaluation Criteria]

Good: The maximum glossiness at the fixing temperature of 180° C. or lower was 20% or greater but less than 40%.

Fair: The maximum glossiness at the fixing temperature of 180° C. or lower was 10% or greater but less than 20%, or 40% or greater but less than 50%.

Poor: The maximum glossiness at the fixing temperature of 180° C. or lower was less than 10%, or 50% or greater.

<<Glossiness Unevenness>>

A solid image (image size: 15 cm×20 cm) was formed on an entire surface of paper, on which a deposition amount of a toner after transferred was 0.65±0.02 mg/cm$^2$, by means of a commercially available copier imageo Neo C600 (available from Ricoh Company Limited).

A temperature of a fixing roller was adjusted per 5° C. from the minimum fixing temperature to the maximum fixing temperature and the sheet was fed in a manner that the longitudinal direction of the sheet was to be vertical to the longitudinal direction of the fixing roller, to measure 60° glossiness of the fixed image.

As a sheet used for the evaluation, coated glossy paper (135 g/m$^2$) available from Mondi was used. As the gloss, 60° gloss of the image was measured on 5 spots on the image in the region of 5 cm×15 cm in the top section of the A4 paper in the orientation of portrait and on 5 spots on the image in the region of 5 cm×15 cm in the bottom section of the A4 paper in the orientation of portrait by means of a gloss meter VGS-1D available from NIPPON DENSHOKU INDUSTRIES CO., LTD., and an average of the values measured at 3 spots excluding the maximum value and the minimum values from the 5 measured values in each section was determined as glossiness of the image. The measurement was performed under the measuring conditions according to JIS-Z8781 (1983 Method 3).

The determined glossiness was evaluated based on the following criteria.

[Evaluation Criteria]

Good: The difference in the glossiness between the top section of the image and the bottom section of the image at the fixing temperature of 180° C. was less than 5%.

Fair: The difference in the glossiness between the top section of the image and the bottom section of the image at the fixing temperature of 180° C. was 5% or greater but less than 10%.

Poor: The difference in the glossiness between the top section of the image and the bottom section of the image at the fixing temperature of 180° C. was 10% or greater.

<<Comprehensive Evaluation>>

The comprehensive evaluation was performed based on the following evaluation criteria.

[Evaluation Criteria]

Good: The results were all "good" in all of the evaluation items.

Fair: There was not "poor" but at least one "fair" in the results of the evaluation items.

Poor: There was one or more "poor" in the results of the evaluation items.

The evaluation results including "poor" even in one evaluation item were regarded as not good (NG) as the comprehensive evaluation.

TABLE 3

| | Toner | Cold offset | Glossiness | Gloss unevenness | Comprehensive evaluation |
|---|---|---|---|---|---|
| Ex. 1 | Toner 1 | Good | Good | Good | Good |
| Ex. 2 | Toner 2 | Good | Fair | Good | Fair |
| Ex. 3 | Toner 3 | Fair | Good | Good | Fair |
| Ex. 4 | Toner 4 | Good | Fair | Fair | Fair |
| Ex. 5 | Toner 5 | Fair | Good | Good | Fair |
| Ex. 6 | Toner 6 | Good | Good | Fair | Fair |
| Ex. 7 | Toner 7 | Fair | Fair | Good | Fair |
| Comp. Ex. 1 | Toner 8 | Fair | Poor | Poor | Poor |
| Comp. Ex. 2 | Toner 9 | Fair | Poor | Fair | Poor |
| Comp. Ex. 3 | Toner 10 | Good | Poor | Fair | Poor |
| Comp. Ex. 4 | Toner 11 | Poor | Poor | Good | Poor |
| Comp. Ex. 5 | Toner 12 | Fair | Poor | Fair | Poor |

For example, embodiments of the present disclosure are as follows.

<1> A toner including:

toner base particles; and an external additive, wherein each of the toner base particles includes a binder resin, a release agent, and silica, an average abundance ratio ($X_{surf}$) of the silica on a region adjacent to a surface of the toner base particle is from 70% through 90%, and a projected area average value S(180) per particle of the toner when the toner is heated to 180° C. and a projected area average value S(30) per particle of the toner when the toner is 30° C. satisfy Formula (1) below, $$1.4 \leq S(180)/S(30) \leq 1.7 \quad \text{Formula (1).}$$

<2> The toner according to <1>, wherein the silica is organosol.

<3> The toner according to <1> or <2>, wherein a surface Si amount of the toner base particles measured by XPS is from 10 atomic % through 30 atomic %.

<4> The toner according to any one of <1> to <3>, wherein an average primary particle diameter of the silica is from 10 nm through 50 nm where the average primary particle diameter of the silica is detected from a transmission electron microscope (TEM) photograph of a cracked surface of the toner base particle.

<5> The toner according to any one of <1> to <4>, wherein an amount of the release agent extracted with n-hexane is from 5 mg through 30 mg per 1.0 g of the toner.

<6> The toner according to any one of <1> to <5>, wherein an average circularity of the toner is from 0.970 through 0.985.

<7> The toner according to any one of <1> to <6>, wherein the toner has at least a second peak particle diameter at a particle diameter that is from 1.21 times through 1.31 times the modal diameter in a volume-standard particle size distribution of the toner.

<8> A toner stored unit including:

a unit; and the toner according to any one of <1> to <7> stored in the unit.

<9> An image forming apparatus including:

an electrostatic latent image bearer;

an electrostatic latent image forming unit configured to form an electrostatic latent image on the electrostatic latent image bearer; and a developing unit configured to develop the electrostatic latent image formed on the electrostatic latent image bearer to form a visible image, where the developing unit includes a toner, wherein the toner is the toner according to any one of <1> to <7>.

The present disclosure can solve the above-described various problems existing in the art and can provide a toner that gives appropriate gloss without impairing low-temperature fixability of the toner and can suppress gloss unevenness.

What is claimed is:

1. A toner comprising:

toner base particles; and an external additive, wherein each of the toner base particles includes a binder resin, a release agent, and silica, an average abundance ratio ($X_{surf}$) of the silica on a region adjacent to a surface of the toner base particle is from 70% through 90%, and a projected area average value S(180) per particle of the toner when the toner is heated to 180° C. and a projected area average value S(30) per particle of the toner when the toner is 30° C. satisfy Formula (1) below, $$1.4 \leq S(180)/S(30) \leq 1.7 \quad \text{Formula (1).}$$

2. The toner according to claim 1, wherein the silica is organosol.

3. The toner according to claim 1, wherein a surface Si amount of the toner base particles measured by XPS is from 10 atomic % through 30 atomic %.

4. The toner according to claim 1, wherein an average primary particle diameter of the silica is from 10 nm through 50 nm where the average primary particle diameter of the silica is detected from a transmission electron microscope (TEM) photograph of a cracked surface of the toner base particle.

5. The toner according to claim 1, wherein an amount of the release agent extracted with n-hexane is from 5 mg through 30 mg per 1.0 g of the toner.

6. The toner according to claim 1, wherein an average circularity of the toner is from 0.970 through 0.985.

7. The toner according to claim 1, wherein the toner has at least a second peak particle diameter at a particle diameter that is from 1.21 times through 1.31 times the modal diameter in a volume-standard particle size distribution of the toner.

8. A toner stored unit comprising:

a unit; and the toner according to claim 1 stored in the unit.

9. An image forming apparatus comprising:

an electrostatic latent image bearer;

an electrostatic latent image forming unit configured to form an electrostatic latent image on the electrostatic latent image bearer; and a developing unit configured to develop the electrostatic latent image formed on the electrostatic latent image bearer to form a visible image, where the developing unit includes a toner, wherein the toner is the toner according to claim 1.

* * * * *